US006474288B1

(12) United States Patent
Blom

(10) Patent No.: US 6,474,288 B1
(45) Date of Patent: Nov. 5, 2002

(54) INTERNAL COMBUSTION ENGINE THAT COMPLETES FOUR CYCLES IN ONE REVOLUTION OF THE CRANKSHAFT

(76) Inventor: Roy Albert Blom, 5592 Nina Cir., Coopersburg, PA (US) 18036

( * ) Notice: Subject to any disclaimer, the term of this patent is extended or adjusted under 35 U.S.C. 154(b) by 0 days.

(21) Appl. No.: 09/722,039

(22) Filed: Nov. 27, 2000

Related U.S. Application Data

(63) Continuation-in-part of application No. 09/031,766, filed on Feb. 27, 1998, now abandoned.

(51) Int. Cl.[7] ..... F02B 75/32
(52) U.S. Cl. ..... 123/197.2; 123/48 R; 418/253
(58) Field of Search ..... 123/18 R, 197.2, 123/241, 78 R, 48 R; 418/58, 142, 253, 270; 91/189

(56) References Cited

U.S. PATENT DOCUMENTS 5,004,409 A * 4/1991 Nakhmanson ..... 418/58
5,419,292 A * 5/1995 Antonov ..... 123/241

* cited by examiner

*Primary Examiner*—Noah P. Kamen

(57) ABSTRACT

An internal combustion engine that completes four cycles, intake, compression, expansion and exhaust in one revolution of the crankshaft is disclosed. The combustion chamber is formed with four parallel vanes joined at their ends by shared bearings and pivot pins within two fixed parallel walls. The vanes lozenge across alternate corners of the chamber to change the volume defined by the four moveable vanes and the two fixed parallel walls. The chamber volume changes from a minimum to a maximum to a minimum and back to the original maximum to achieve four cycle operation with one crank shaft revolution. The crankpin may have two side by side connecting rods rotating each of the adjacent driven vanes. The driven vanes may be connected about a common shared pivot pin that extends into the fixed side walls and the other two interconnected follower vanes may be driven in rotation and translation about their shared and common pivot pins.

40 Claims, 46 Drawing Sheets

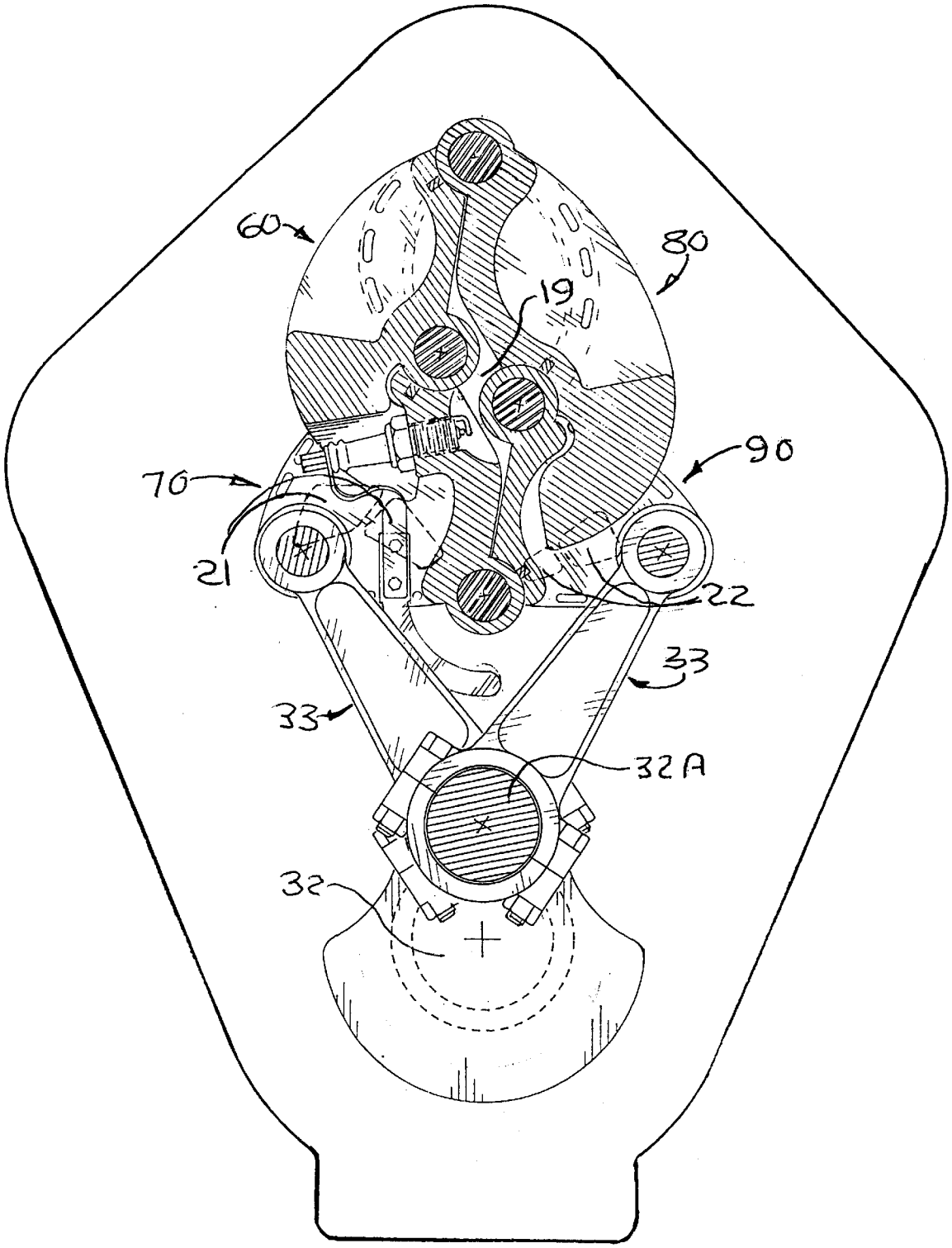
60
80
19
90
70
21
22
33
33
32A
32

INTERNAL COMBUSTION ENGINE THAT COMPLETES FOUR CYCLES IN ONE REVOLUTION OF THE CRANKSHAFT

CROSS-REFERENCE TO RELATED APPLICATIONS

This application relates to, draws priority on, and is a continuation-in-part of prior U.S. patent application Ser. No. 09/031,766 filed Feb. 27, 1999, abandoned.

FIELD OF THE INVENTION

The present application relates to internal combustion engines and methods of operation thereof. More specifically, the invention relates to 4 cycle engines with spark or compression ignition, that are capable of completing 4 cycles in one revolution of the crankshaft and having automatic opening of the intake and exhaust ports.

BACKGROUND OF THE INVENTION

There are two factors that have been important in determining the direction of development of the internal combustion engine. The first factor is the increasing cost of fuel due to a global shortage. The second is the necessity to reduce pollution into the atmosphere.

There have been two main thrusts in the recent development of the internal combustion engine. The first development has been in engine fuel ignition and gas control management where electronic computers that sense engine parameters have been employed. The sensed parameters are used to calculate necessary fuel injection rates and fuel is supplied at the proper rate and ignition is advanced or retarded as required. This computerized fuel and ignition control system has been very successful in reducing pollution and increasing fuel efficiency.

The second development thrust has been in mechanical improvements. The need to improve volumetric efficiency or breathing has resulted in engines having four valves per cylinder head, turbo charging, variable opening valves, variable intake valve throttles and fuel injection directly to the cylinders or indirectly through the manifold. This has lead to greater mechanical complexity and the attendant higher manufacturing costs.

There are mechanical limitations to efficient engine management. Examples are the restriction in high speed operation due to valve bounce and limiting sympathetic crankshaft vibration.

A further example of an inherent mechanical restriction is apparent from the scavenging process. In a four valve per head engine, as the valves become larger they become closer, permitting the intake charge to flow directly from the intake valve, to the exhaust valve and port, without driving the remaining exhaust gases out. Also, some of the intake gases will flow into the exhaust port and then back into the cylinder during the intake stroke but this is erratic and unpredictable.

Another mechanical limitation results in poor flame front propagation. In a piston cylinder engine, the gas is ignited at the top of the cylinder and the piston is retreating from the flame front. It is known that if charged gases are pushed toward the flame front, substantially better and more complete combustion would be possible.

If the number of cylinders could be reduced, the engine could be lighter and smaller with a shorter crankshaft. If lower speed operation and higher R.P.M.'s were possible, engine flexibility would be improved and a lower number of transmission gear ratios would be required for engines in vehicles, this in turn would lead to lower weights and better economy.

Dynamic unbalance in an engine can be eliminated by a balance shaft running at two times engine speed but this causes additional mechanical cost and mechanical complexity. If a single chamber engine is in balance this balancing would make possible all types of engine arrangements such as V, inline and radial and with any number of cylinders.

An ideal engine should have the simplicity of a two cycle engine with self opening ports and with the ability to run at high speed, requiring only one revolution per power stroke, this would reduce the number of chambers required and also eliminate the need for valves, valve springs, lifters, rocker arms, camshaft, reduction gears, chain drive and separate cylinder head and gasket. This simplified engine should not require lubrication of the chamber walls internally by adding lubrication to the intake gas charge entering the cylinder chambers as in a two cycle engine as this lubricant is consumed and it will cause pollution.

An improved engine arrangement will have the hot exhaust valves and port areas away from the intake and compression areas this will prevent preignition therein permitting higher compression ratios that will give better thermal efficiency and that will lower fuel costs and contribute to reduced pollutions.

OBJECTS OF THE INVENTION

It is therefore a main object of the present invention that this engine will complete four cycles, intake, compression, expansion and exhaust in one revolution of the crankshaft, that this will require only half the number of cylinders for an equal number of power pulses per revolution, which will reduce weight, size and length. This reduction in length will also reduce the crankshaft length and improve the crankshaft torsional stiffness.

A further related object is to provide an engine that will not require mechanically operated valves, this engine will have intake and exhaust ports that are covered and uncovered by the gas control chamber members and the engine will have four ports, two opposed intake ports and two opposed exhaust ports that are on opposite fixed walls of the gas chamber and are utilized to sweep the exhaust gases from the exhaust chamber during the overlap period of exhaust and intake openings.

An object of the present invention is to eliminate valves, springs, lifters, rocker arms, tappets, camshaft, camshaft bearings, reduction gears for the camshaft and a timing belt required by a conventional four cycle piston engine.

A related object will be to eliminate the head to block joining and gasketing problems.

It is a further object of this invention that each individual gas control chamber of this engine will be in primary dynamic balance using a crankshaft counterweight, this will permit different engine configurations such as "V", flat and inline with varying number of cylinders.

Yet another object of this invention is to eliminate the two major detriments to high speed engine operation in a conventional four cycle piston engine, the first being valve bounce and the second is limiting sympathetic crankshaft vibration.

A further related object is to provide an engine that will be more efficient having a potential for higher compression ratios and having more consistent and less erratic flame front travel and that this will translate into a less polluting engine by having a gas control chamber that will move the gas into the flame front, this will promote faster and better combustion and additionally reduce knock that results from poor end gas combustion.

A related object will be to remove the intake and compression strokes from the hot exhaust port area to permit a higher compression ratio with the same octane fuel and this will translate directly into higher thermal efficiency and reduced exhaust emissions.

A further object is to scavenge the engine gas chambers during the overlap of the exhaust and the start of the intake stroke accomplished by delaying the fuel injection during this initial period when the intake gases are flushing out the exhaust gases.

A further object is to produce good squish action that will direct opposed jets of gas towards each other in the gas control chamber to promote swirl and turbulence of the fuel mixture for more complete combustion.

It is a further object of this invention that the volume to surface area ratio will be similar to a conventional four cycle engine, and the gas control chamber will have no sharp recurvate angles, to quench the flame front.

Another object of the present invention is to provide a ratio of port area to valve area that is similar to a four valve per cylinder conventional piston engine.

A further object is to provide gas sealing that is similar to a conventional engine with groove seals using gas pressure to force the seal against the sealing surface and the side of the groove and with an oil control ring to scrape and wipe excess oil from the moving sealing surfaces to reduce oil consumption while still providing adequate lubrication.

It is yet another object to provide an engine that will be operational dimensionally stable, that can be made larger or smaller and operate in a manner similar to large and small four cycle conventional piston engine.

It is a further related object that this invention can be operated as a diesel engine with compression ratios of 23:1 or higher and with compression ignition, while still maintaining an adequate bearing area.

Another object is to provide an engine that will be substantially lower in manufacturing cost than a conventional four cycle piston engine.

Other objects and advantages of this invention will become apparent from a consideration of the following specifications and drawings. Before proceeding with a detailed description of the invention, however, a brief description of it will be presented.

SUMMARY OF THE INVENTION

A first embodiment of the invention that will be described is an improvement of the four cycle internal combustion engine, the engine described will be a two chamber engine, for simplicity the operation of one chamber is described. The engine will have a four sided gas control chamber operating between two fixed parallel containing walls with opposite sides of this gas control chamber parallel and with opposite sides equal in length between their four commonly hinge pin ends and with the vanes equal in width and contained and slidable between two parallel walls that are spaced apart the width of these vanes. The vanes having flanges parallel to the containing walls to provide a surface for sealing of the gas control chamber and to transfer the heat of combustion to the parallel side containing walls. With the two adjacent vanes that are on either side of the extended main hinge pin and that are driven having bearings that are parallel to the hinge pins that are used to locate the wrist pins. The parallelogram of vanes free to rotate and translate about the extended main pin that is perpendicular to and located by the closing side walls.

This gas control chamber will be operated by a crankshaft the axis of which is perpendicular to the parallel fixed side wall, and free to rotate in bearings fixed by the side containing walls and with a crankpin bearing located between the containing wall that will have two rotatable side by side connecting rods that will drive the two driven vanes of the gas control chamber through a wrist pin located at the opposite end of the connecting rods these commonly connected to each other by the main crankpin and being restricted to rotary motion by this extended main pin. The wristpin will be displaced from the main hinge pin at a distance so the rotation of the crankshaft will rotate the crankpin and impart a driving motion to the wrist pin through the connecting rod to rotate these two driven vanes, that will in turn rotate and translate the opposite two follower vanes about their common hinge pin so that they are driven in translation and rotation that will cause the parallelogram gas control chamber to lozenge and close across alternate corners and this then will cause the volume to be reduced to a minimum for maximum compression when the crankpin is at top dead center. The crankshaft will continue to rotate towards bottom dead center to pass through a maximum expansion and the gas control chamber will be reduced in volume to a fixed minimum compression ratio for the completion of the exhaust and the start of the intake that occurs at bottom dead center. The crankshaft rotation will continue through bottom dead center and when the gas control chamber hinge pin axis are at a right angle with the gas control chamber at maximum volume and this will end the intake stroke. The compression stroke that follows will be completed when the crankpin is at top dead center, at this time ignition will occur and the 4 cycles will be repeated again.

Another aspect of this invention is the operation of the intake and exhaust ports, these ports are located adjacent to the main hinge pin in the side containing wall and behind the flanges of the wristpin driven vanes of the gas control chamber and will be opened and closed at the appropriate time in the following manner, as the crankshaft rotates past top dead center and ignition of the compressed charge occurs and when expansion is almost complete, the vane that is driven on the side of the gas control chamber that covers the exhaust port will be uncovered and start to open due to the rotation of this driven vane and as the crankshaft rotates and approaches bottom dead center, the crankpin motion will be generally side to side and this side to side oscillation about the main hinge pin rotating about the main hinge pin will be transmitted and will rock the whole gas control chamber so as to keep the vane on the intake side closed until bottom dead center is reached then the mostly side to side motion of the crankpin will rotate the gas control chamber rapidly causing the intake port to be uncovered and the exhaust port to close and as the crankpin continues to rotate through the next quadrant the motion will rotate the driven vane assembly causing the intake to close and the compression portion of the cycle to begin, ending with the crankshaft at top dead center once again, to begin again the four cycles required for a four stroke internal combustion engine.

Another aspect of this engine, is that it can be substantially balanced for both the reciprocating and oscillating motion of the center of mass of the gas control chamber and the side by side rotary rocking of the gas control chamber. It can be seen that the center of mass of the vanes of the gas control chamber is rotating counter to the counter weight rotation diametrically opposite the crankpin and this constitutes a couple about the mass of the engine that will cancel.

The foregoing and other objects, features and advantages of the invention will be apparent from the following more particular description of the preferred embodiments of the invention, as illustrated in the accompanying drawings.

BRIEF DESCRIPTION OF THE DRAWINGS

The following is a brief description of the drawings of various embodiments of the present invention, in which like reference numerals are used to refer to like elements.

FIG. 11E is a partial schematic view of section 5—5 of FIG. 2 with the crankshaft rotated counterclockwise 180 degrees.

FIG. 32 is a scrap view taken along line 32—32 of FIG. 31.

FIG. 33 is a scrap view taken along line 33—33 of FIG. 31.

DESCRIPTION OF THE PREFERRED EMBODIMENTS

A two combustion chamber engine will be shown but for simplicity the operation of the rear gas control chamber that is closest to the flywheel will be described. The front gas control chamber is similar but 180 degrees out of phase in its operation. To better illustrate and describe the sealing system views of the front and rear chambers will be utilized.

Figure 1:
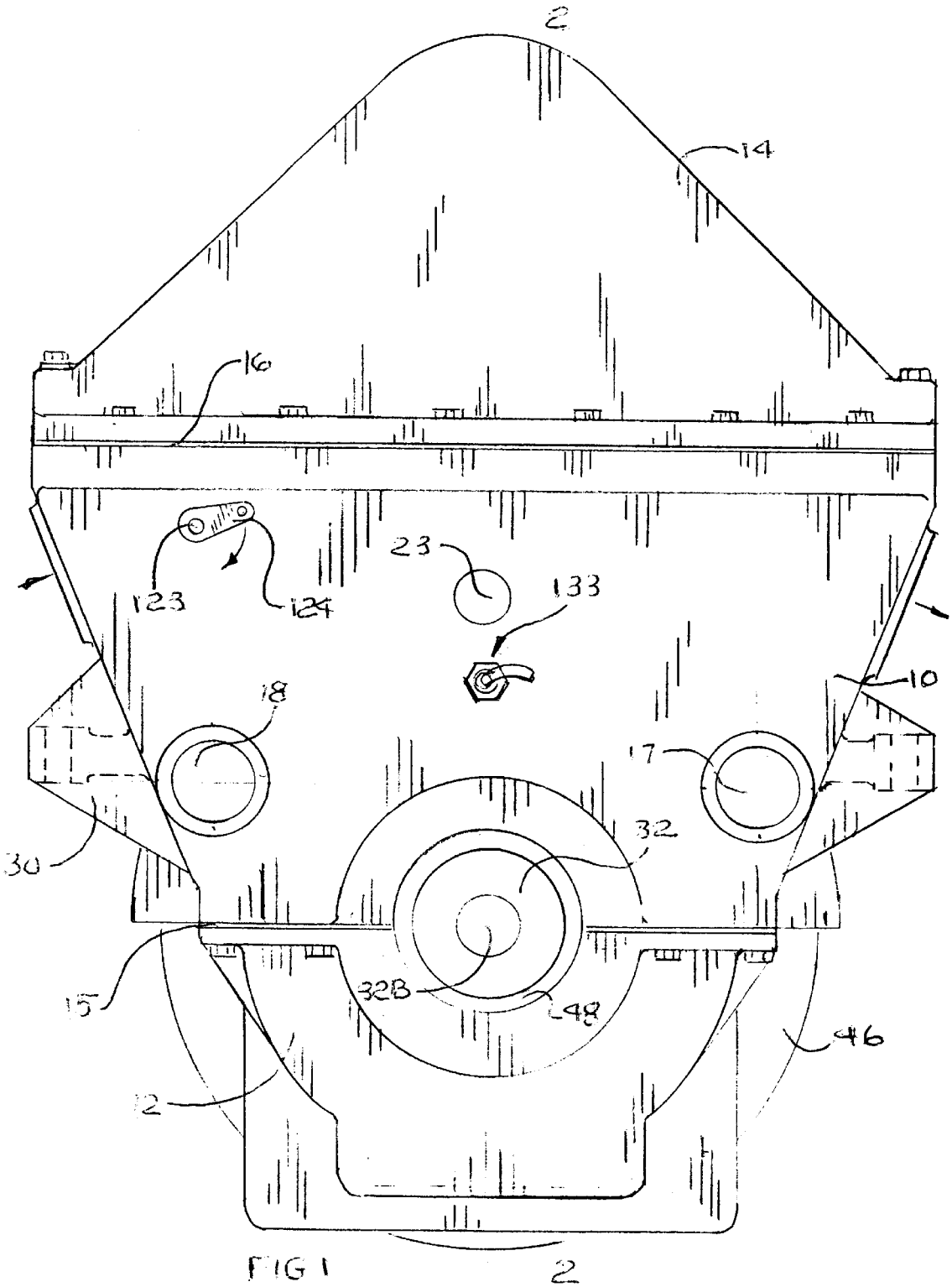
FIG. 1 is a front view of a first embodiment of the present engine invention.

FIG. 1 illustrates the engine front view, the flywheel 46 being located at opposite end. Shown are the engine block 10 with coolant inlet 17 and coolant exit 18, and 3 engine mounting brackets 30, two located on one side and one on the opposite side for supporting the engine. The top cover 14 is secured to the block 10 with gasket 16 interposed for sealing. Also secured to engine block 10 is the crankcase cover 12 with gasket 15 interposed with the crankshaft oil seal 48 clamped between the block and the crankcase cover. Also located by engine block 10 will be throttle control arm 124 and throttle shaft 123 for the front gas control chamber with a similar arrangement on the rear face for the rear gas control chamber. An electrical plunger assembly 133 will be secured for the front combustion chamber and located on the rear wall a similar electrical plunger assembly 133 will be located for the rear gas control chamber. Shown projecting from the joint between the block 10 and crankcase 12 will be the crankshaft 32 with a reduced diameter projection 32 B suitable for mounting velocity and positional transducers of a type well known in the art that will be utilized for a computerized computer control module or an ignition control device that is not shown.

Figure 2:
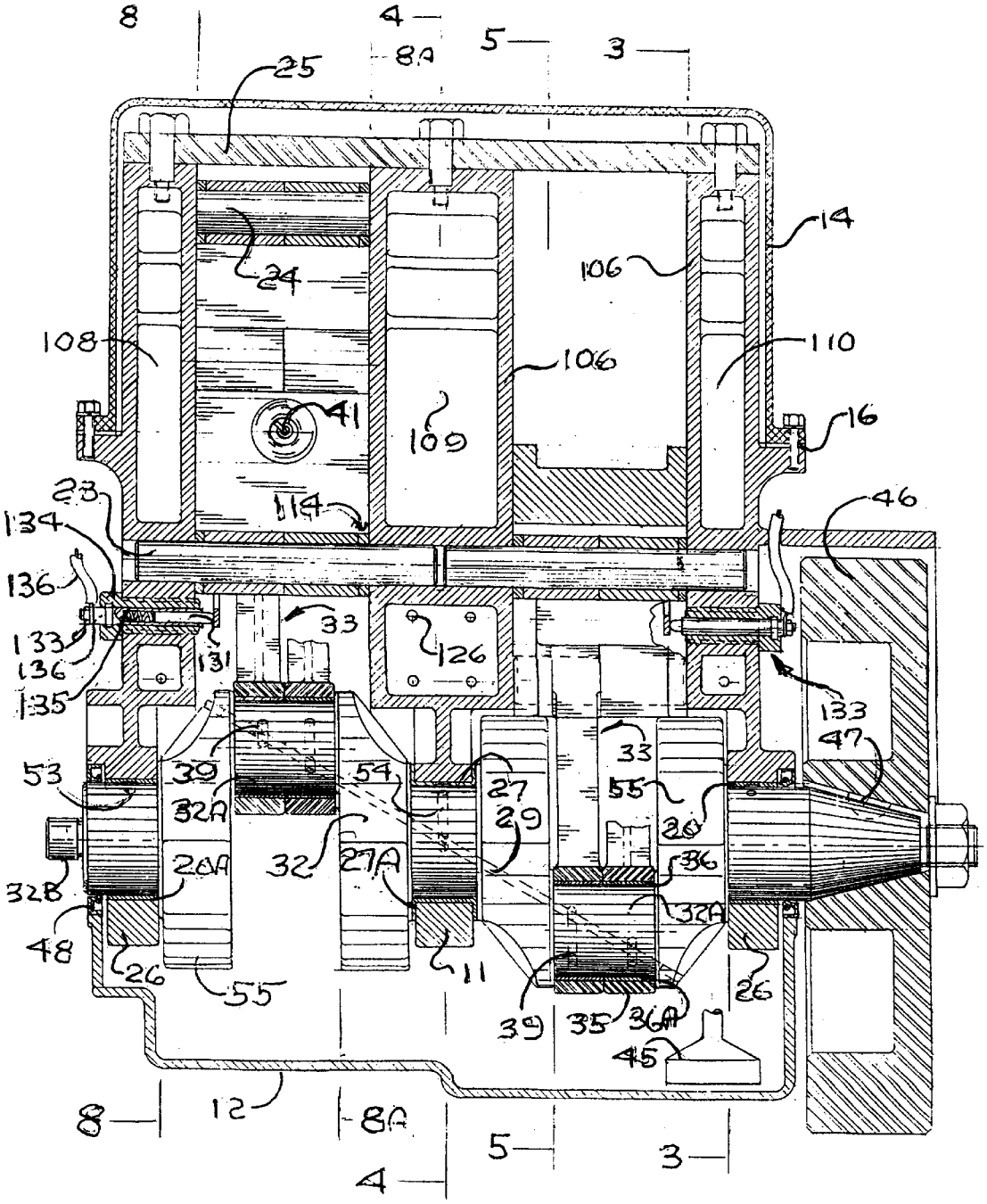
FIG. 2 is a sectional side view taken along line 2—2 of FIG. 1.
Figure 3:
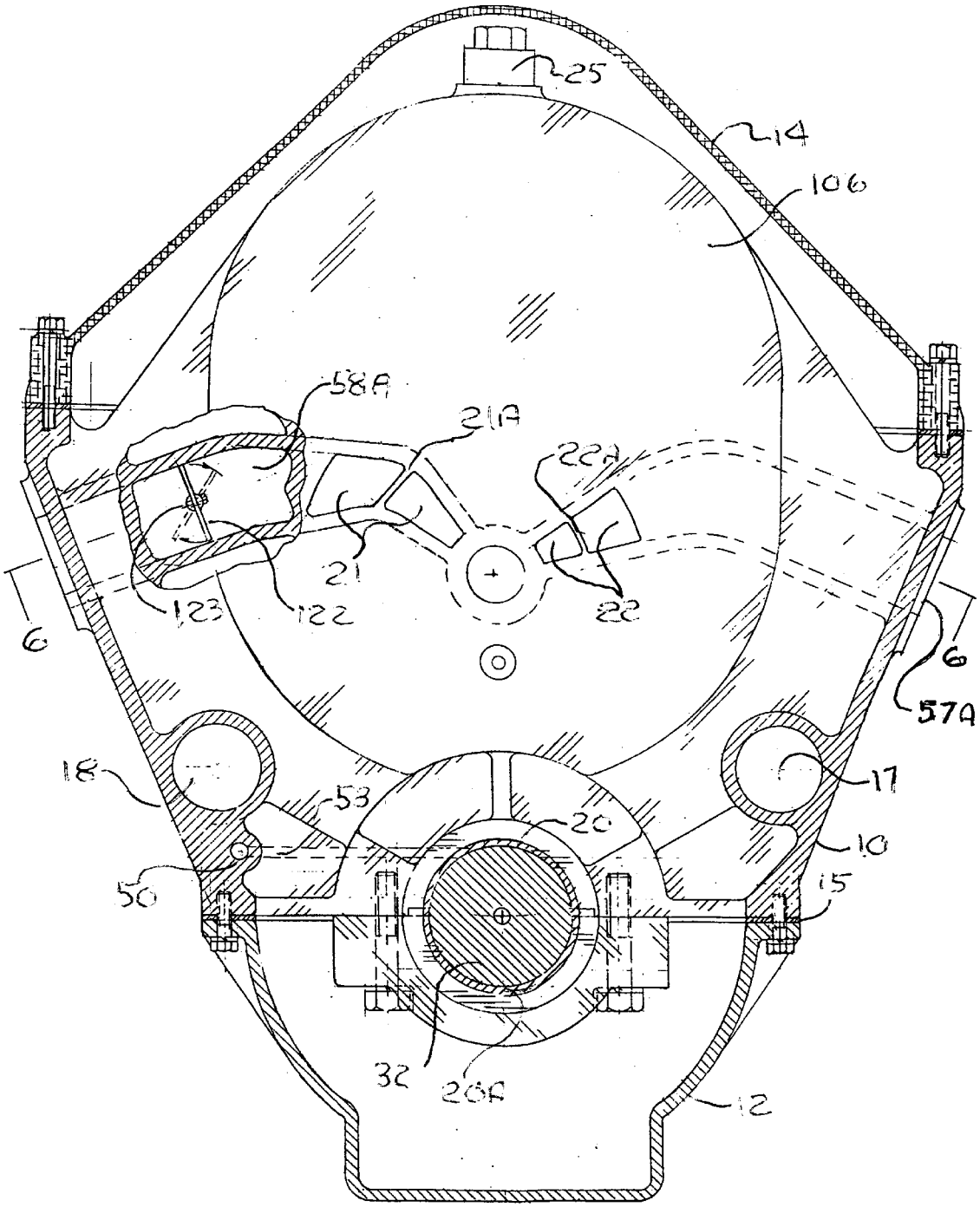
FIG. 3 is a sectional view taken along line 3—3 of FIG. 2.
Figure 5:
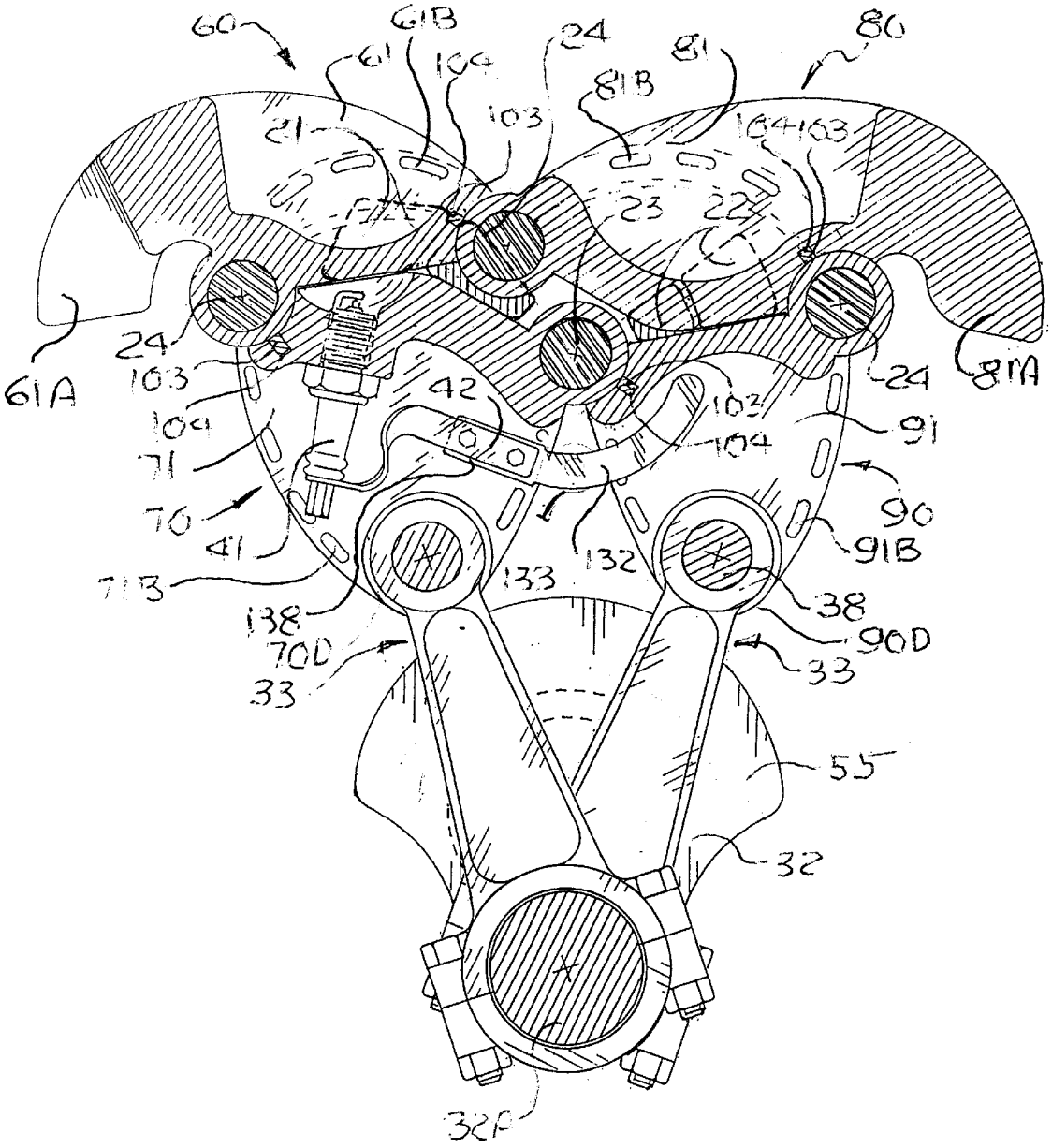
FIG. 5 is a partial section taken along line 5—5 of FIG. 2 with an offset through the center line of the sparkplug.

In FIGS. 2, 3 and 5 the engine block 10 will provide a suitable rigid structure to support the crank shaft 32 that will be rotatable located by the 2 end caps 26 that will clamp the front and rear main journal bearing halves 20 and 20A when the caps are secured and in a similar manner the crankshaft 32 center journal will be rotatable located by the bearing cap 11 and thrust bearing halves 27 and 27A, the thrust bearings will prevent axial motion of the crankshaft 32.

A flywheel 46 will be secured to the crankshaft 32 with a key 47 that will prevent relative motion between the crankshaft 32 and the flywheel. The flywheel 46 will be at a size to store sufficient rotational energy from the power stroke to complete the exhaust, intake and compression strokes without significant loss of rotational speed.

The two crankpins 32A of the crankshaft 32 are diametrical opposed and equally spaced 180 degrees about the main crankshaft journal. Rotatable located on each of the crankpins 32A in a side by side axial arrangement are two connecting rod assemblies 33 that will be secured to the crankpin by bearing cap 35 that will clamp the connecting rod bearings halves 36 and 36A with the opposite terminus of the connecting rod assembly 33 being rotatable connected by floating wrist pins 38 in bosses 70D and 90D in the right and left driven vane assemblies 70 and 90. The floating wrist pins 38 being located axially by the fixed walls 106.

The engine housing cover 14 is secured to the main engine block with a gasket 16 to retain the lubrication; it also permits access for replacing the spark plugs 41, this is best shown in FIG. 5, that when the crankpin 29 is at top dead center that this sparkplug can be readily accessible for removal and replacement.

The tie bar 25 which is dowelled and secured to the engine block 10 in three places will prevent the fixed walls 106 of the gas control chamber from spreading apart from the force exerted by the gas pressure from the gas control chamber 19.

Rotating oil seals 48 seal against the crankshaft 32 end main journal bearing, and are clamped between the main engine block 10 when the crankcase 12 is secured to the engine block 10 with a gasket 15 between to prevent lubrication oil from leaking outside the crankcase. All lubricating oil that is removed from the fixed wall 106 of the gas control chamber by the oil control scraper ring and the lubricating oil passing out of the bearings and components that are lubricated will be returned to the crankcase 12 and be removed by the oil sump pickup 45 for return to the engine. This lubrication oil when a pressurized oil lubrication system is utilized will be returned to the main engine block 10 where it will be distributed to the 3 main bearings by a main oil gallery 50 that is connected to oil distribution passages 53 through a hole and groove in each main bearing half to the main crankshaft bearings and further distributed to the center of the crankshaft through hole 54 and cross drilled passage 29 and then to the connecting rod assembly bearing halves 36 and 36A by cross drilled holes 39. Excess oil escaping and passing out the ends of the main crankshaft bearing and the connecting rod bearings will be distributed to the other components requiring lubrication by the splashing and churning of the oil by the crankshaft 32 and counterweight 55. It is to be noted that in a low cost version of this gas control chamber engine a simple splash lubrication system with lubricating oil maintained at between suitable levels 56 will suffice. This is best illustrated in FIG. 4.

Figure 4:
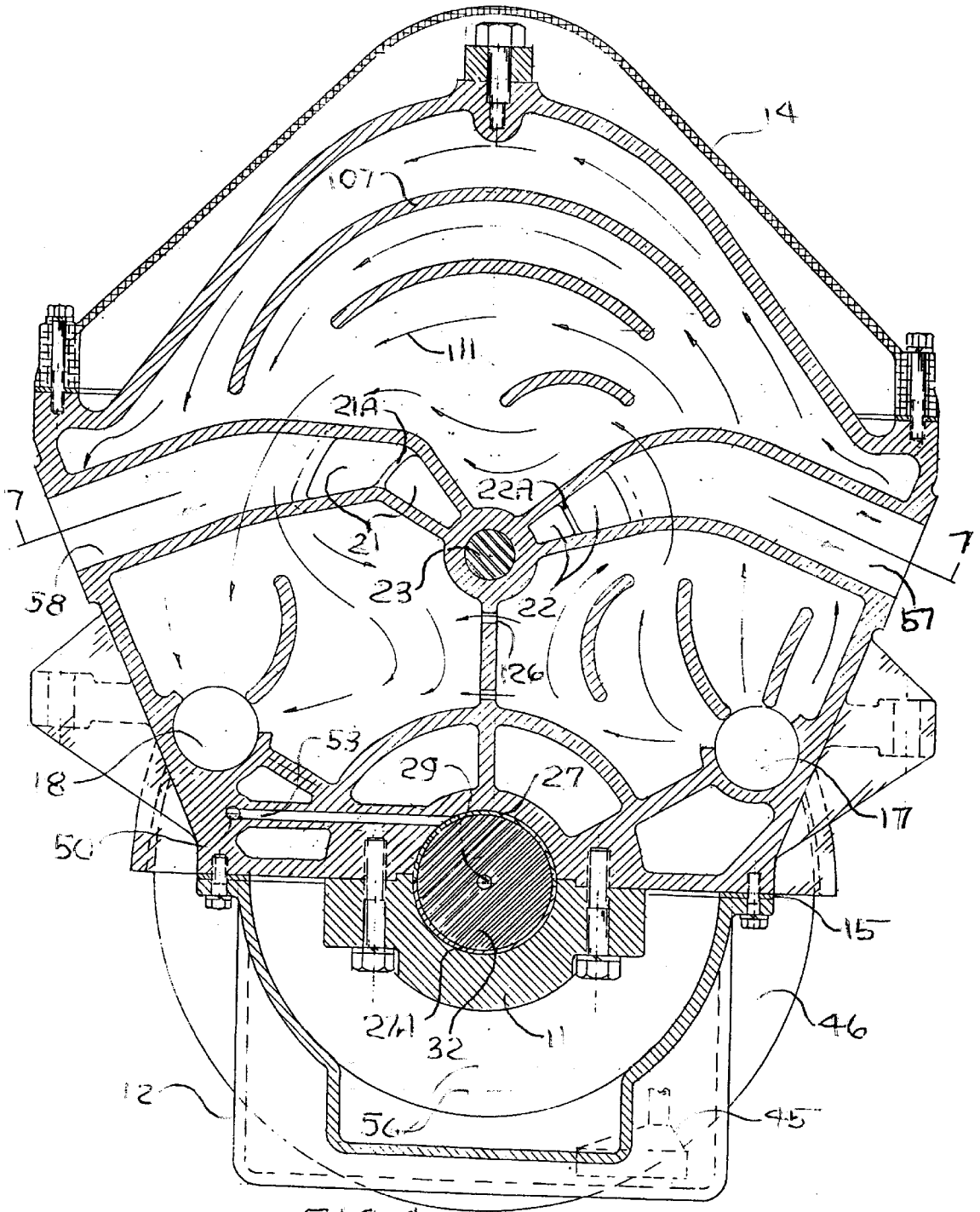
FIG. 4 is a sectional view taken along line 4—4 of FIG. 2.
Figure 6:
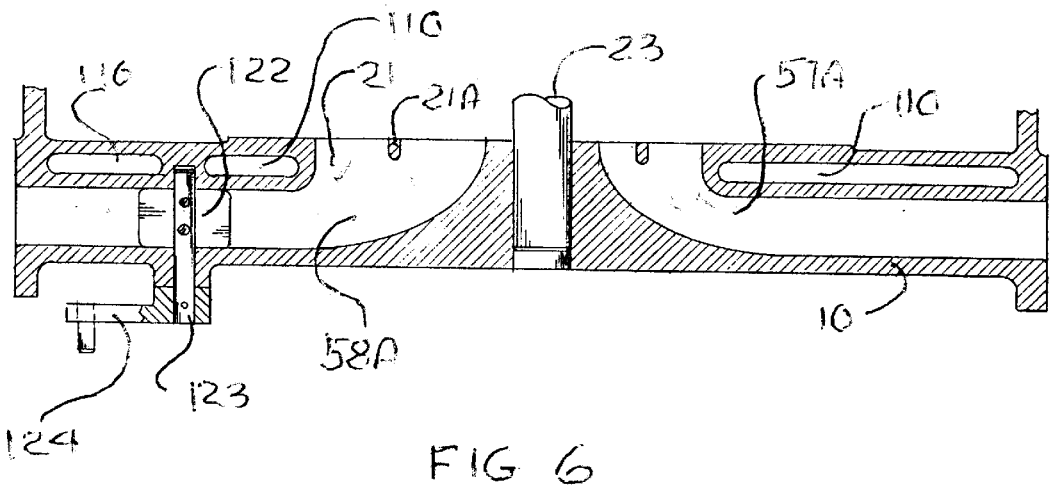
FIG. 6 is a sectional view taken along line 6—6 of FIG. 3.
Figure 7:
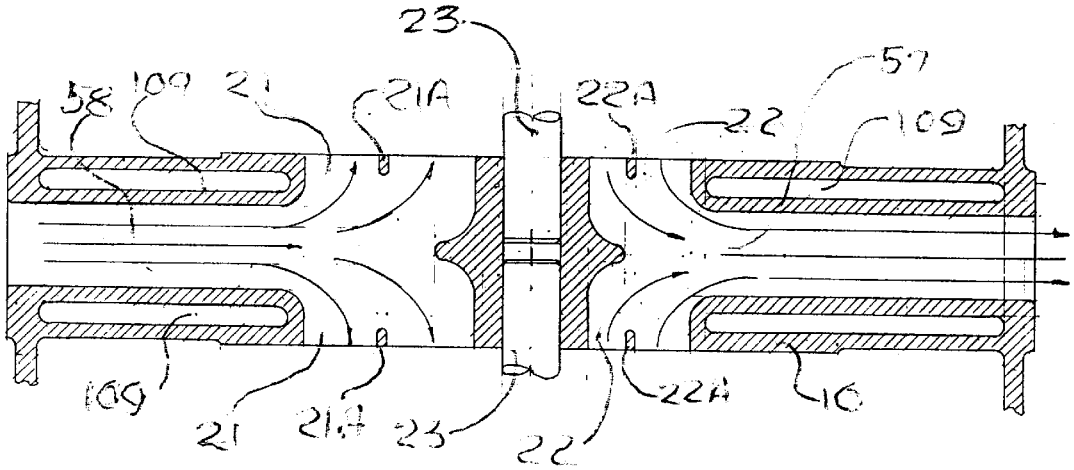
FIG. 7 is a partial section taken along line 7—7 of FIG. 4.
Figure 8:
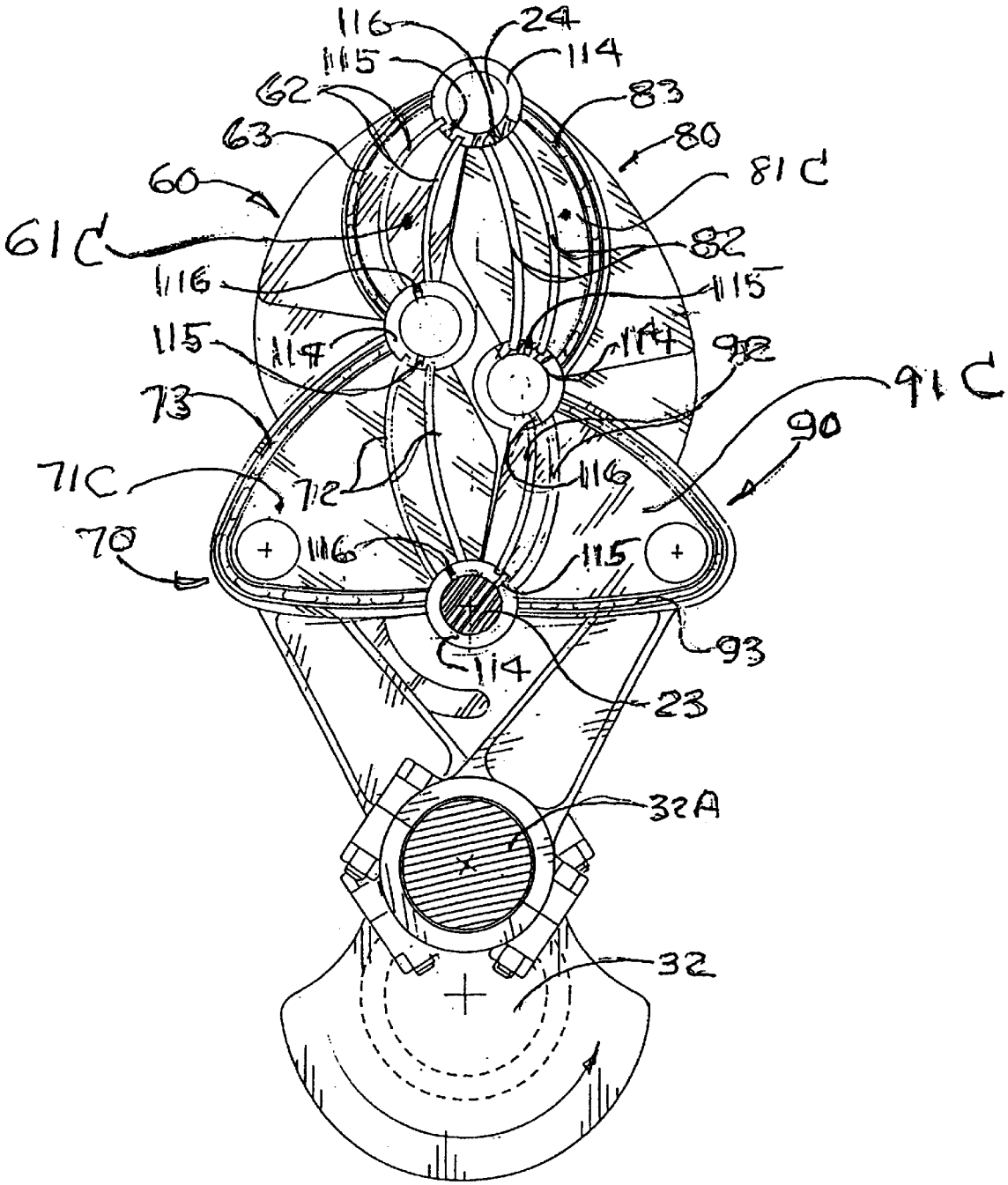
FIG. 8 is a partial view taken along line 8—8 of FIG. 2.

In FIG. 4 the flow of the coolant is indicated by flow line 111 with fins 107 directing the coolant flow for uniform cooling around the obstructions such as gas control chamber intake duct 58 and exhaust duct 57. FIG. 7, shows how the coolant passes on either side of the exhaust duct wall 57 and intake passage wall 106. FIG. 6 shows the coolant flow past intake duct 58A and exhaust duct 57A and the fixed side walls 106. To prevent stagnant coolant from becoming trapped and vaporized behind the partition small bleed holes 126 will provide a low coolant flow between the right and left sides of the coolant jacket. Coolant fluid will enter through manifold 17 through the main engine block 10 to cool the fixed walls 106 of the variable gas control chamber and in turn to cool the vane assemblies 60, 70, 80 and 90 by transmitting heat from the gas control chamber 19 through the flanges 61C, 71C, 81C and 91C and through the gas seals 62, 72, 82 and 92 and the oil control scraper rings 63, 73, 83 and 93 as illustrated in FIG. 8. The low temperature coolant will flow from the manifold 17 through the front center and rear coolant jacket 108, 109 and 110, with the coolant flowing through to the opposite coolant return manifold 18 where it will exit. It is to be appreciated that this coolant flow with the low temperature coolant flowing through the high temperature area of the fixed walls 106 of the gas control chamber, first and to the cooler area after, will reduce the distortion from a true plane of the fixed walls 106 and improve the sealing of the gas control chamber.

In FIG. 5 is illustrated the general arrangement of the vane assemblies 60, 70, 80 and 90 that are rotatable connected at their ends by hinge pins 23 and 24. Hinge pins 24 are fully floating and located axially between fixed walls 106. The main hinge pin 23 is secured in fixed walls 106.

The floating wrist pins 38 are rotatable located in flange bosses 70D and 90D in the driven vane assemblies 70 and 90 and axially located by fixed walls 106.

It is to be noted that the entire assembly consisting of vane assemblies 60, 70, 80 and 90 may be withdrawn from the engine block 10 by removing top cover 14 and crankcase cover 12, hinge pin 23 and connecting rod bearing caps 35 to facilitate repair, assembly and disassembly.

FIG. 5 showing the arrangement for conduction of electrical pulses to the moving spark plug 41, an electrical commutator 132 secured with insulator 138 interposed between the driven vane assembly 80 will conduct the electrical pulse to the spark plug 41 through a strap conductor 42 that is secured to spark plug 41, the electrical pulses are supplied to the commutator by electrical plunger assembly 133, shown in FIG. 2, which has a nose piece conductor 131 wiping against commutator 132 that is spring loaded against plunger piece 131 by spring 135 through conductor tube 136. The whole assembly being insulated from the engine block 10 by an insulator body 134 secured in engine block 10, the ignition lead 137 being secured to the conducting tube 136.

Referring to FIGS. 8, 8A, 9 and 10 in the following description of the gas seals 115, 116, 103, 62, 72, 82, 92, 63, 73, 83 and 93 it is to be appreciated that the seals are urged against their respective mounting surfaces by the biasing springs but that the major sealing force will be applied by gas pressure behind the gas seals forced against their respective faces with increasing force the increase in sealing forces being proportional to the gas pressure. In a similar manner the gas seals will be forced against their side wall grooves in a direction opposite the gas pressure to seal against the pressure that will vary from positive to negative on both sides of the gas control chamber 19 during the intake, compression, expansion and exhaust strokes. It is also to be appreciated that the flange seals 62, 72, 82, 92, 63, 73, 83 and 93 will be more stable with reduced chatter, due to stick slip phenomena, when they are curved along their length.

Figure 9:
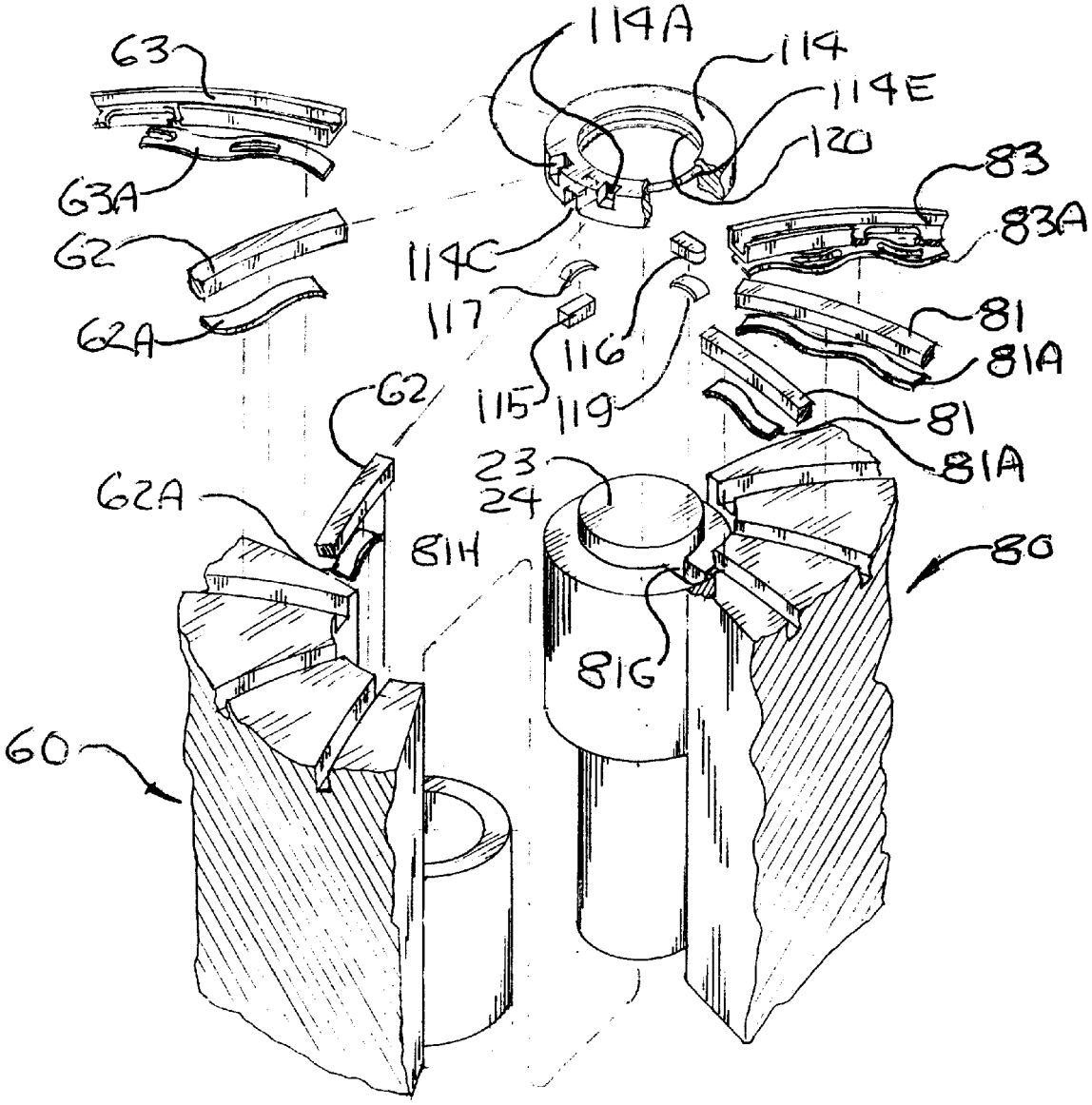
FIG. 9 is a schematic perspective view of the sealing system between adjacent vanes used for the first embodiment of the present invention.

In FIG. 9 a sealing system is shown that will seal the vane hinge joined vanes 60 and 80 and the fixed walls 106 at one terminus of the hinge pin 23 or 24, sealing off the vanes at both ends of the hinge pins 23 and 24 between vane assemblies, the seals between vane assemblies, 80 and 90, 90 and 70, 70 and 60 will be similar.

An annular ring seal 114 located by hinge pins 23 or 24 will have radial slots 114A in the periphery to accept the flange seal ends 62. Opposite the fixed walls 106 will be a slot 114C with spring 117 to urge seal 115 against the counterbore face 81H located in vane assembly 80 on the face of 81H in a slot 81G seal 116 will be urged by spring 119 against the annular ring seal face 114D.

The annular ring seal will have a groove 114E deep enough to break into slots 114A with a split ring 120 spring to urge flange seal 62 against their opposite terminus which will be the annular ring seal 114 between vane assembly 60 and vane assembly 70. Seals 72, 82 and 92 in both flanges will be urged against the unslotted outside radius of the next annular ring seals 114.

Figure 8A:
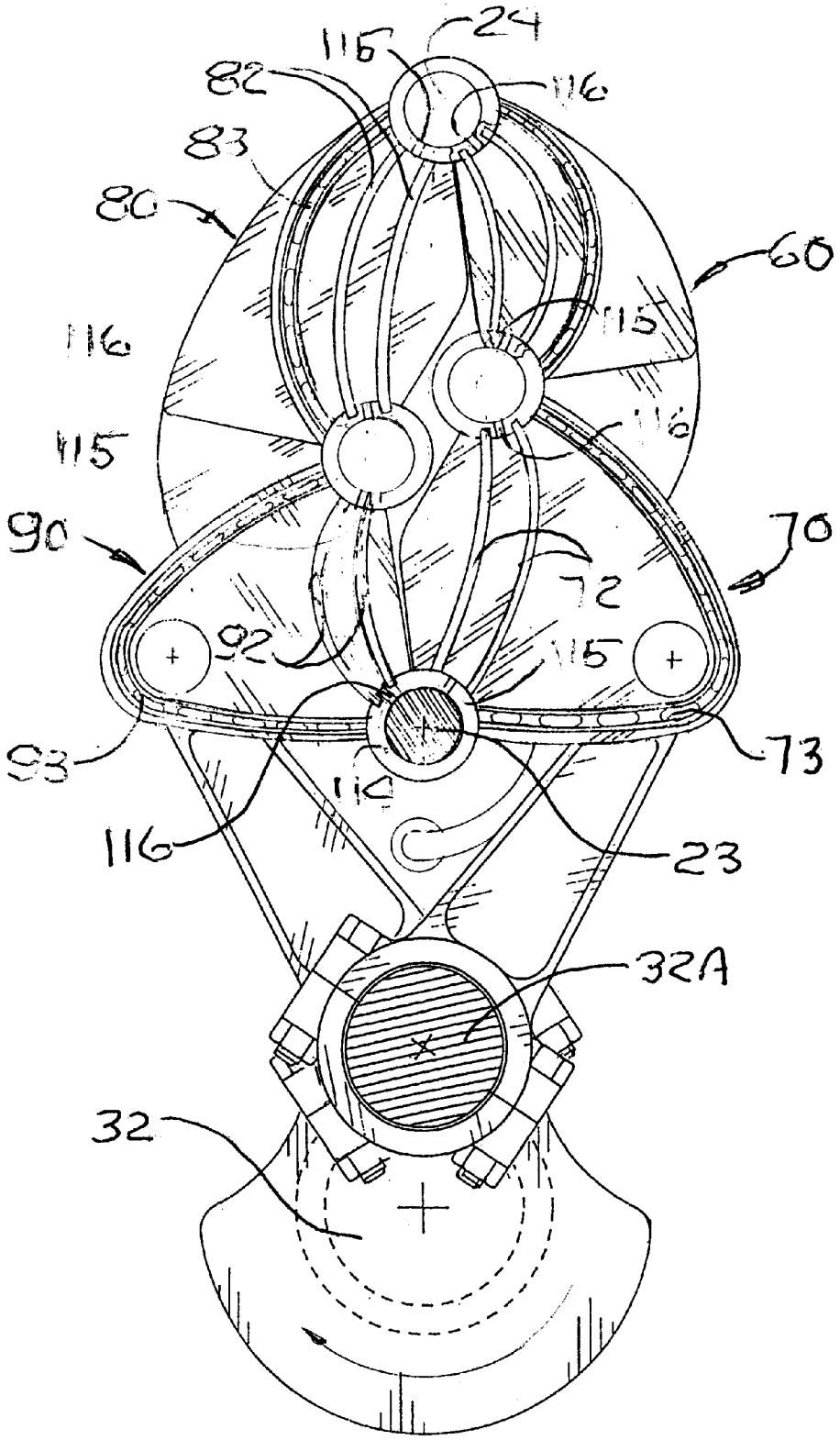
FIG. 8A is a partial view taken along line 8A—8A of FIG. 2.

In FIG. 9 and also illustrated in FIGS. 8 and 8A and located on vane flange 62, 72, 82 and 92 on both sides of vane assemblies 60, 70, 80 and 90 will be located a plurality of flange seals 62, 72, 82 and 92 that are urged upward against fixed walls 106 by springs 62A, 72A, 82A and 29A. One end of vane seals 62, 72, 82 and 92 will fit into slots 114C of a similar size and shape to drive the annular ring seals 114 in rotation. On intake ports 21A and exhaust ports 22 bridges 21A and 22A will guide the flange seals 62, 72, 82 and 92 over the port edges.

Combination oil control and gas flange seal 63, 73, 83 and 93 being urged against fixed walls 106 by spring 63A, 73A, 83A and 93A having slots to permit oil sheared from fixed walls 106 to return to engine crankcase 12 through slots 60B, 70B, 80B and 90B with the terminus of the oil control and gas flange seals riding against of the outside diameter annular ring seal 114.

Figure 10:
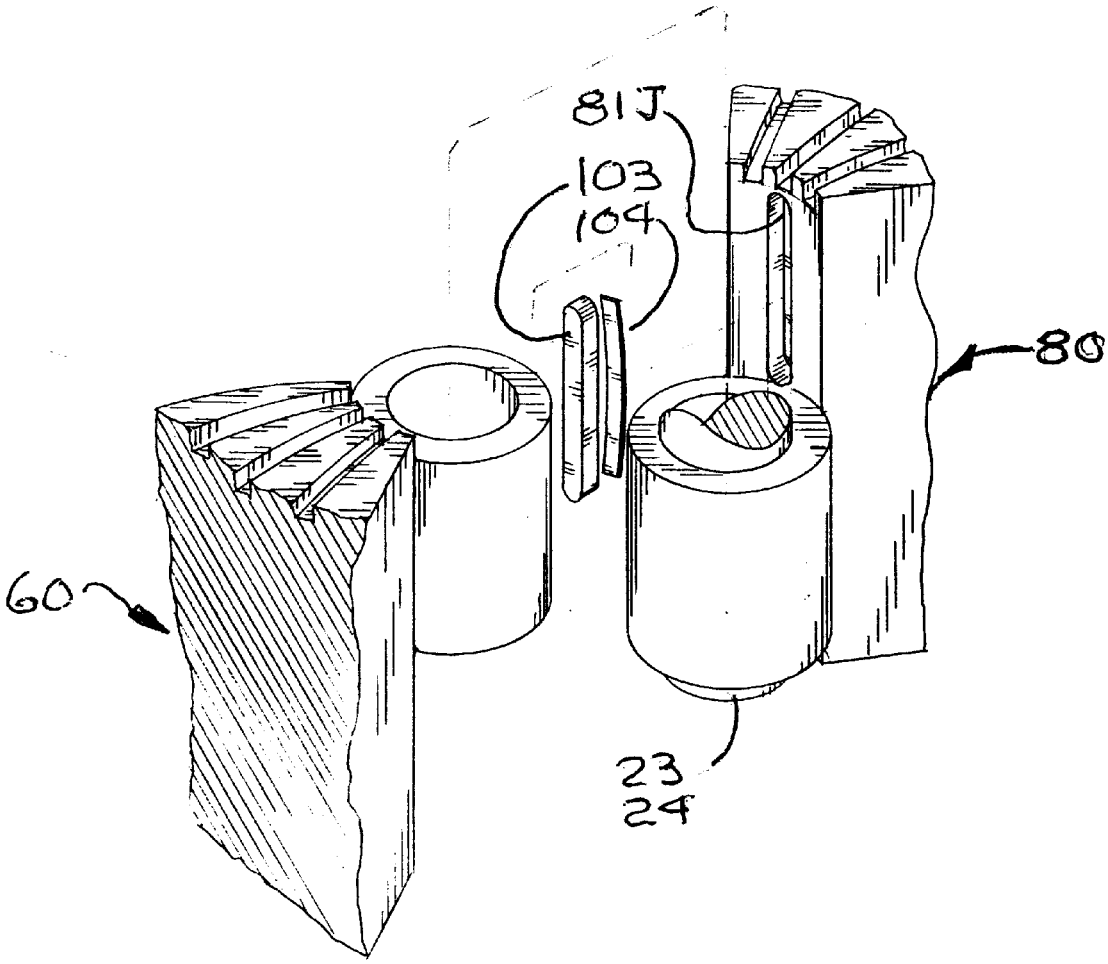
FIG. 10 is a schematic perspective of the hinge sealing system used for the first embodiment of the present invention.

In FIG. 10 showing the hinged joint between vane assemblies 60 and 80 the hinge boss seals 103 are set into axial groove 81J that is parallel to the hinge pin and located on the concave surface of the vane counterbore and urged against the next adjacent vane hinge convex bosses by spring 104. Hinge joints, 80 and 90, 90 and 77 and 70 and 60 will be similar.

Figure 11A:
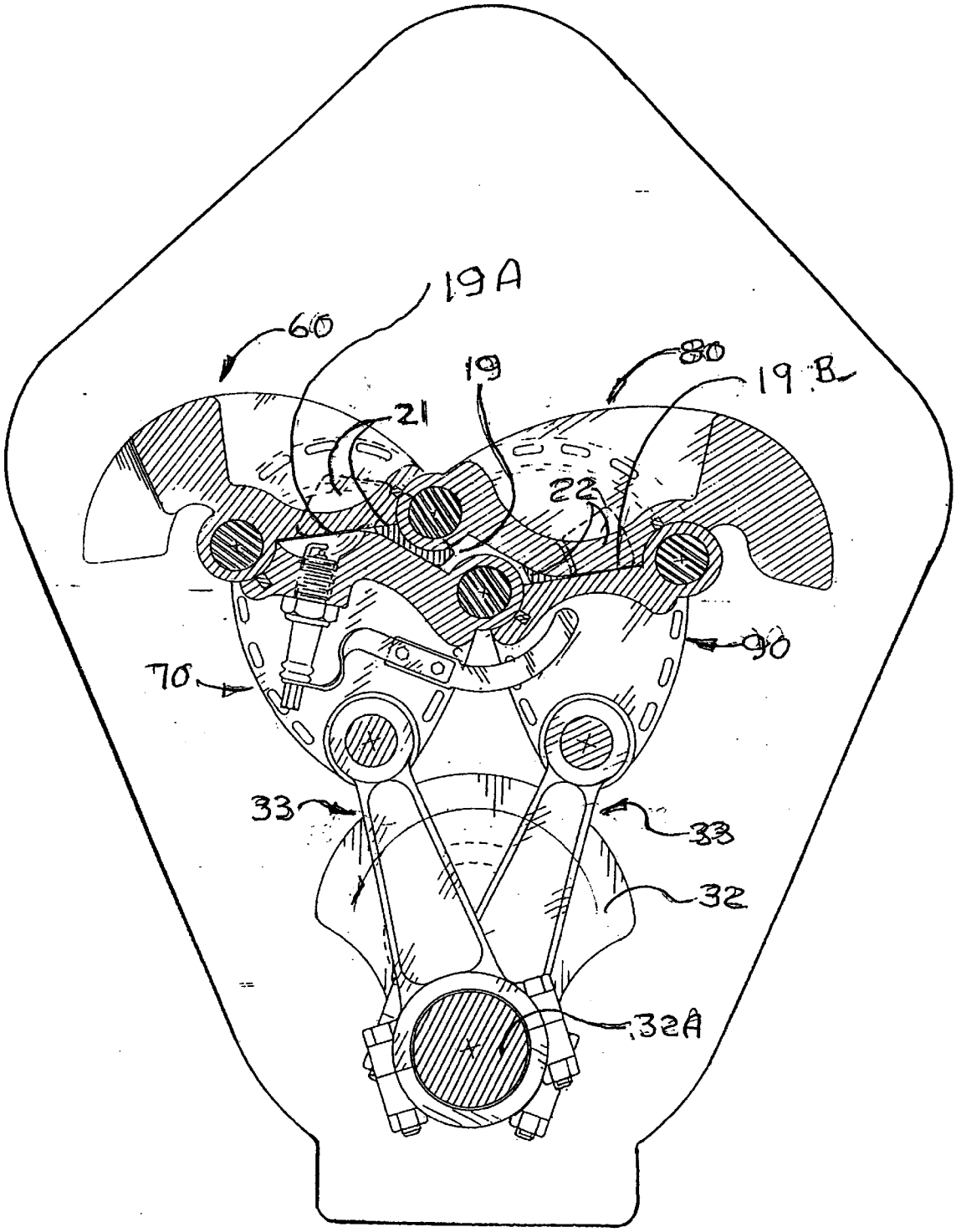
FIG. 11A is a partial schematic view of section 5—5 of FIG. 2 when the crankshaft is at top dead center.

FIG. 11A illustrates the gas control vane assemblies 60, 70, 80 and 90 when the exhaust stroke is ending and the crankpin 32A is at bottom dead center and the crankshaft 32 is rotating counterclockwise with the intake port 21 partially open and the exhaust port 32 partially open and scavenging of the exhaust gases by the intake gases is continuing with the injection of fuel into the manifold at this overlap of the exhaust port 22 and intake 21, being delayed, so that fuel will not go into the exhaust port and be wasted. This fuel economy will also occur in a direct fuel injection engine where injection is delayed until compression is started. The opposing action of the squish areas 19A and 19B is shown by the arrows in the gas control chamber 19.

Figure 11B:
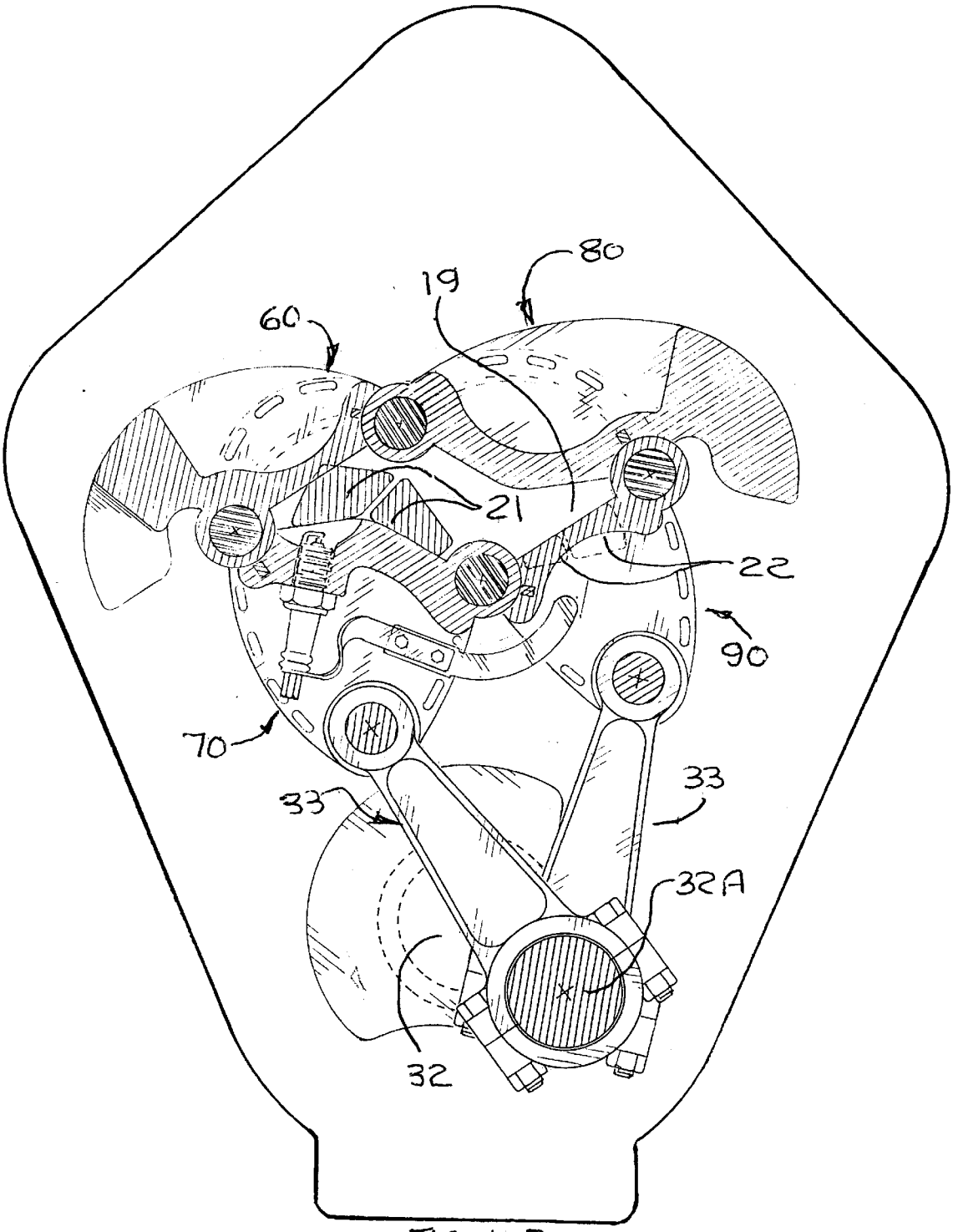
FIG. 11B is a partial schematic view of section 5—5 of FIG. 2 with the crankshaft rotated counterclockwise 45 degrees.

In FIG. 11B the crankshaft 32 and crankpin 32A have rotated 45 degrees counterclockwise and the exhaust port 22 is now closed and the intake port 21 is fully open and the intake cycle is in progress scavenging has been completed and return of gases through the exhaust port 22 has been blocked.

Figure 11C:
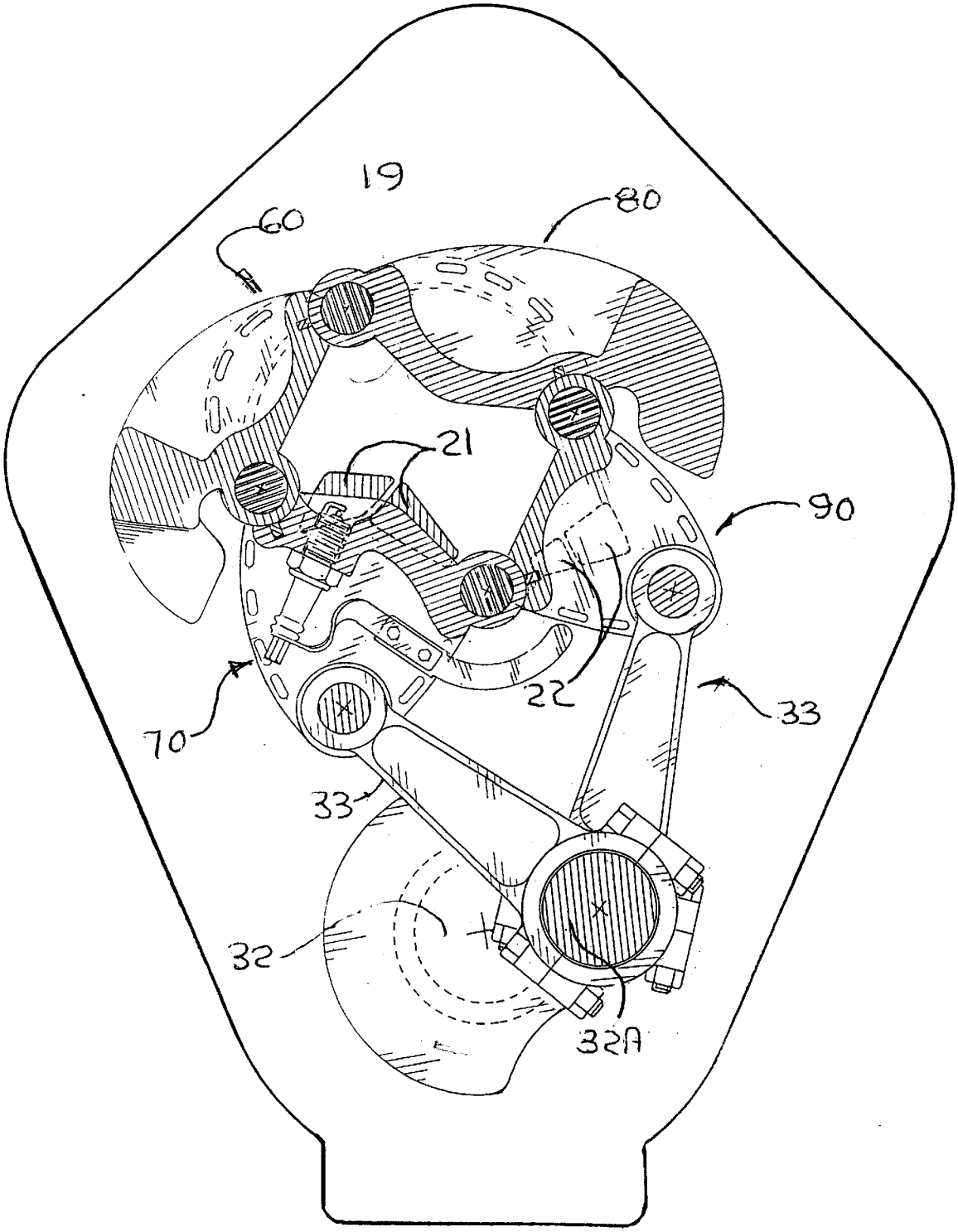
FIG. 11C is a partial schematic view of section 5—5 of FIG. 2 with the crankshaft rotated counterclockwise 98 degrees.

In FIG. 11C the crankshaft 32 and crankpin 32A have rotated 98 degrees counterclockwise and vane assembly 70 flanges 71C is closing the intake port 21 and the gas control chamber 19 volume is now at a maximum, the intake port will remain open as the high velocity of the intake gases will contribute to supercharging the gas control chamber 19 when the compression stroke starts.

Figure 11D:
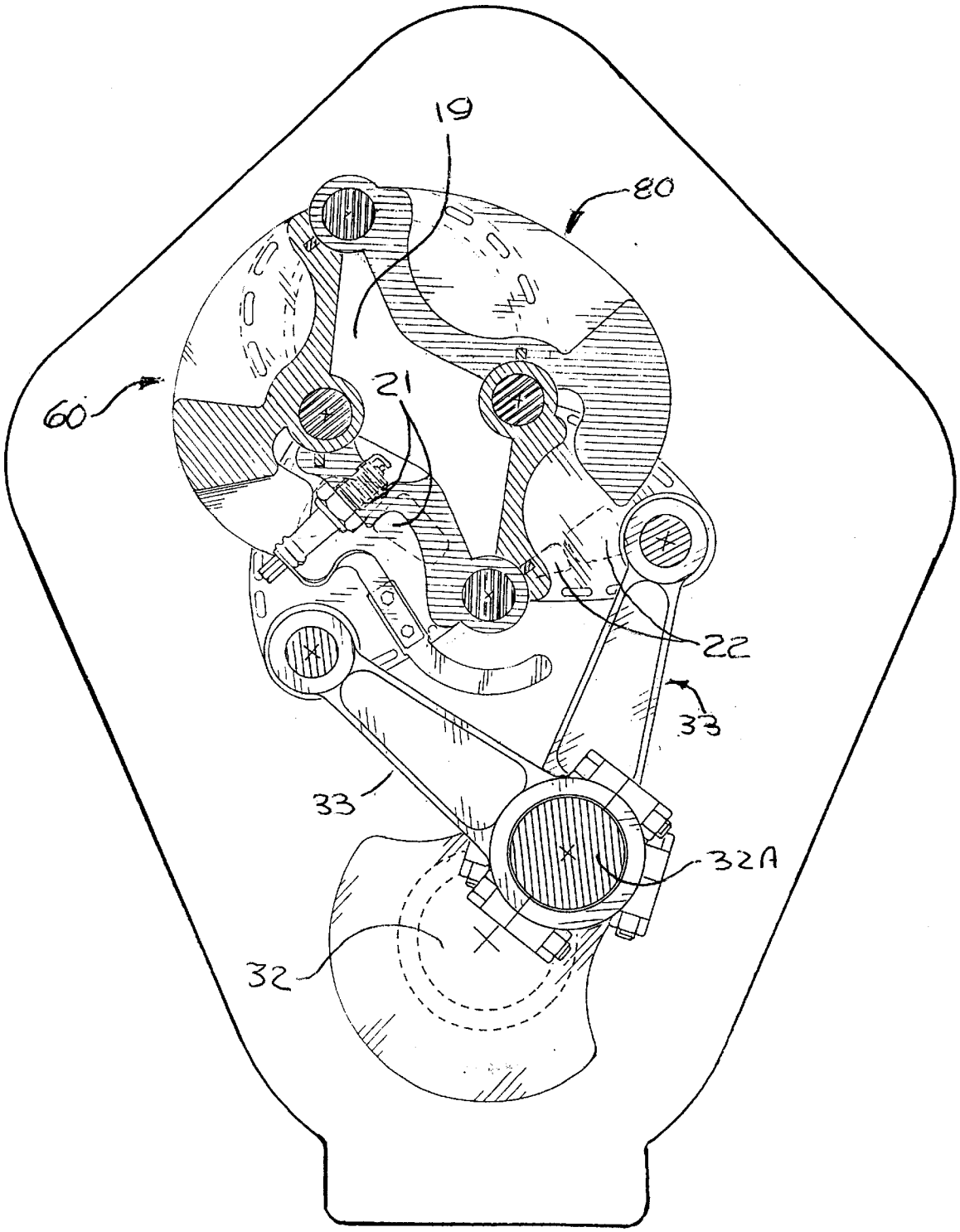
FIG. 11D is a partial schematic view of section 5—5 of FIG. 2 with the crankshaft rotated counterclockwise 138 degrees.

In FIG. 11D the crankshaft 32 and crankpin 32A have rotated 138 degrees from bottom dead center intake 21 and exhaust port 22 are closed and compression in the gas control chamber is in progress. it is to be noted that during the compression stroke the gas control chamber 19 is not in proximity to the hot exhaust port reducing the tendency for intake gas charge to preignite at high compression ratios.

In FIG. 11E the crankshaft 32 and crankpin 32 have rotated 180 degrees to top dead center and the gas control chamber volume is at a minimum and ignition by the spark plug or by compression ignition has occurred at a suitable period prior to this time and expansion will now take place. It is to be noted at this phase when the gas control chamber is at a maximum that the oil control flange seals 73 and 93 do not pass over the intake port 24 and exhaust port 23 apertures and this will prevent lubricant from entering these port areas.

Figure 11F:
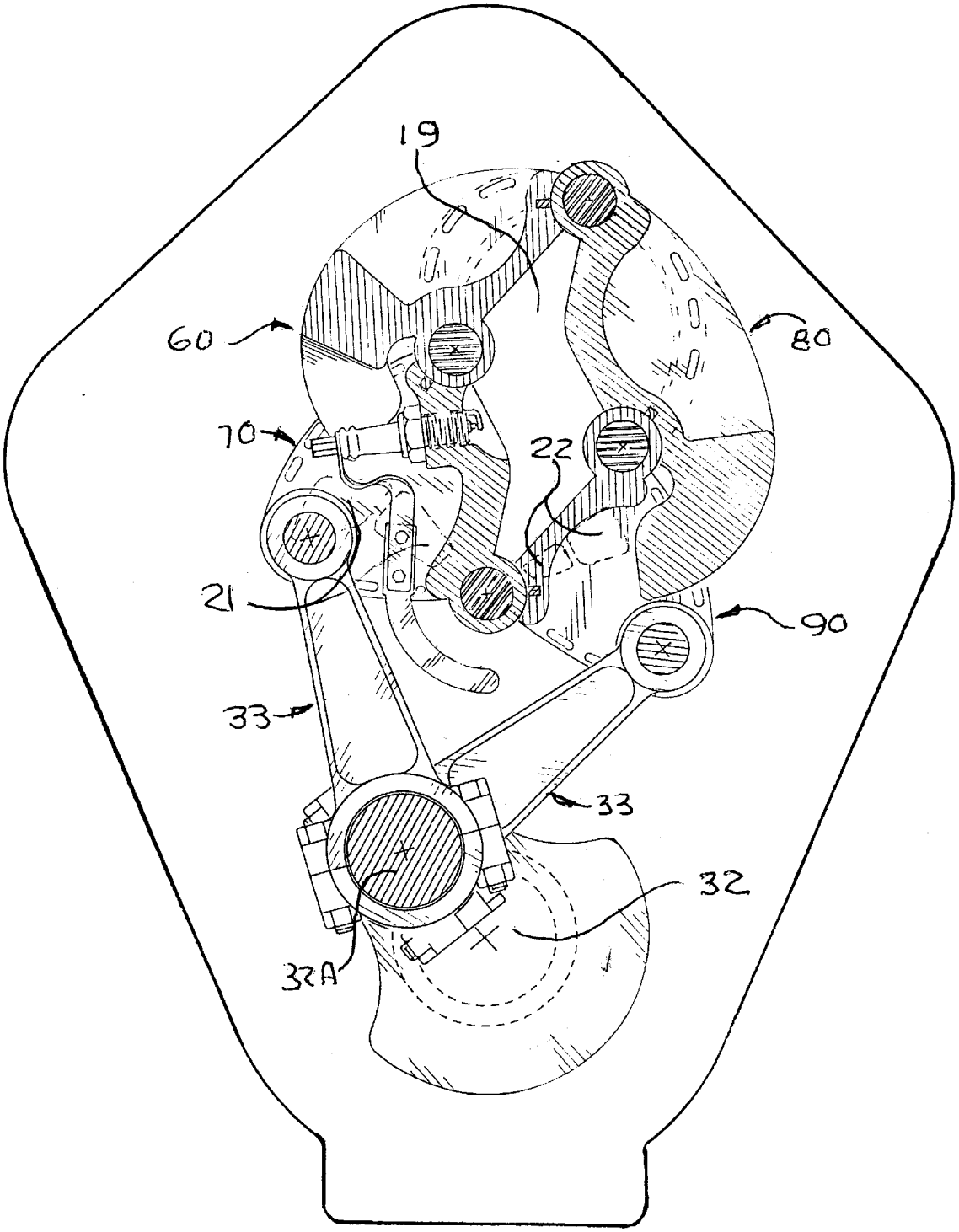
FIG. 11F is a partial schematic view of section 5—5 of FIG. 2 with the crankshaft rotated counterclockwise 222 degrees.

In FIG. 11F the crankshaft 32 and crankpin 32A have rotated counterclockwise 45 degrees past top dead center and the expansion stroke is in progress.

Figure 11G:
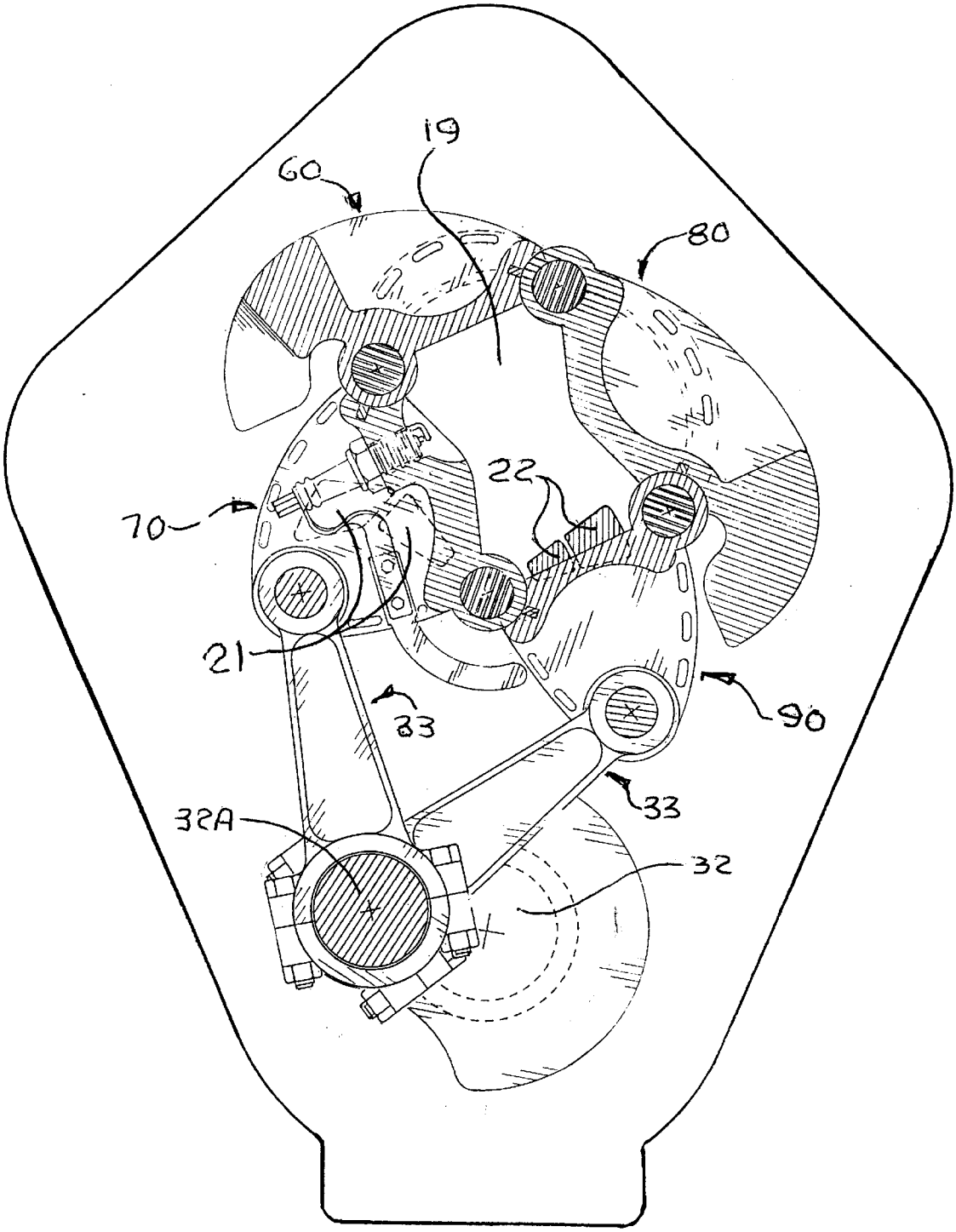
FIG. 11G is a partial schematic view of section 5—5 of FIG. 2 with the crankshaft rotated counterclockwise 262 degrees.

In FIG. 11G the crankshaft 32 and crankpin 32A have rotated counterclockwise 98 degrees from top dead center and the gas control chamber is at a maximum the exhaust port 22 has opened to begin the exhaust stroke.

Figure 11H:
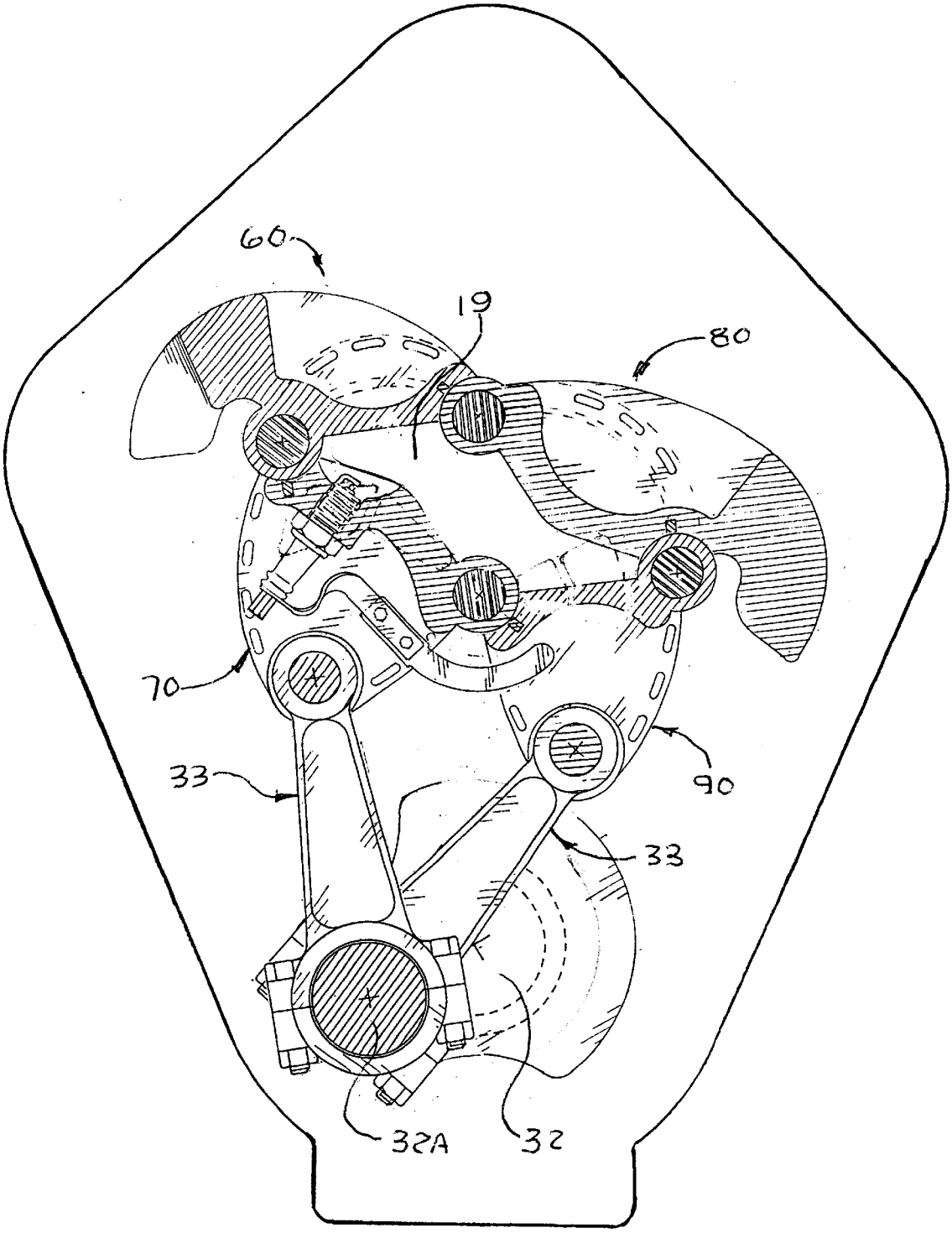
FIG. 11H is a partial schematic view of section 5—5 of FIG. 2 with the crankshaft rotated counterclockwise 315 degrees.

In FIG. 11H the crankshaft 32 and crankpin 32A have rotated 138 degrees counterclockwise from top dead center. The exhaust cycle is continuing with the exhaust port 22 being closed by the vane assembly flange 80 flange 81C.

Figure 11J:
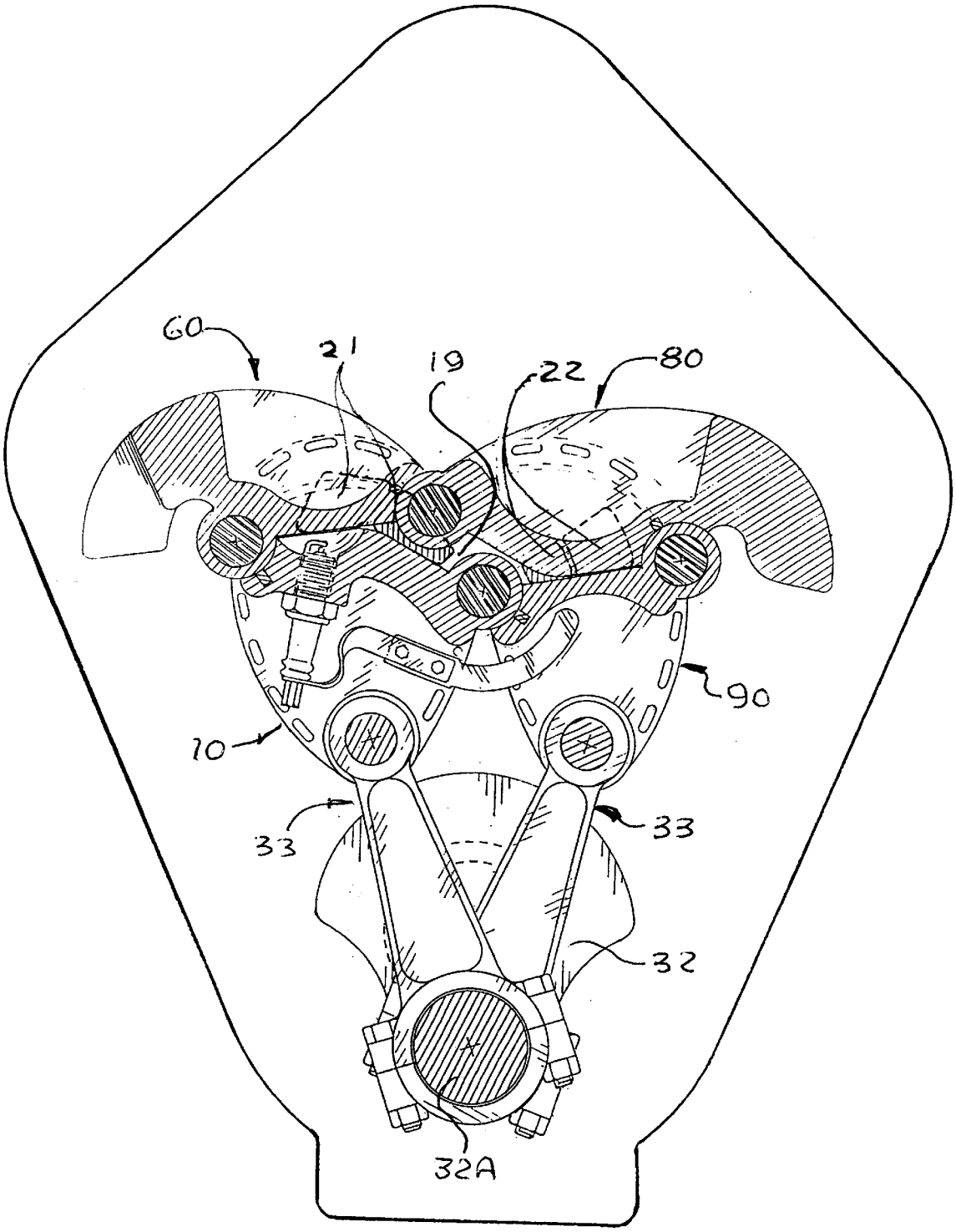
FIG. 11J is a partial schematic view of section 5—5 of FIG. 2 with the crankshaft rotated counterclockwise 360 degrees, which is the same as FIG. 11A.

In FIG. 11J the crankshaft 32 and crankpin 33A have rotated to bottom dead center. The intake port 21 is partially open and the exhaust port 22 is partially open for exhaust gas scavenging and this will complete the four strokes or cycles of intake, compression, expansion and exhaust that begins with the gas control chamber in the same starting position as FIG. 11A.

Figure 12:
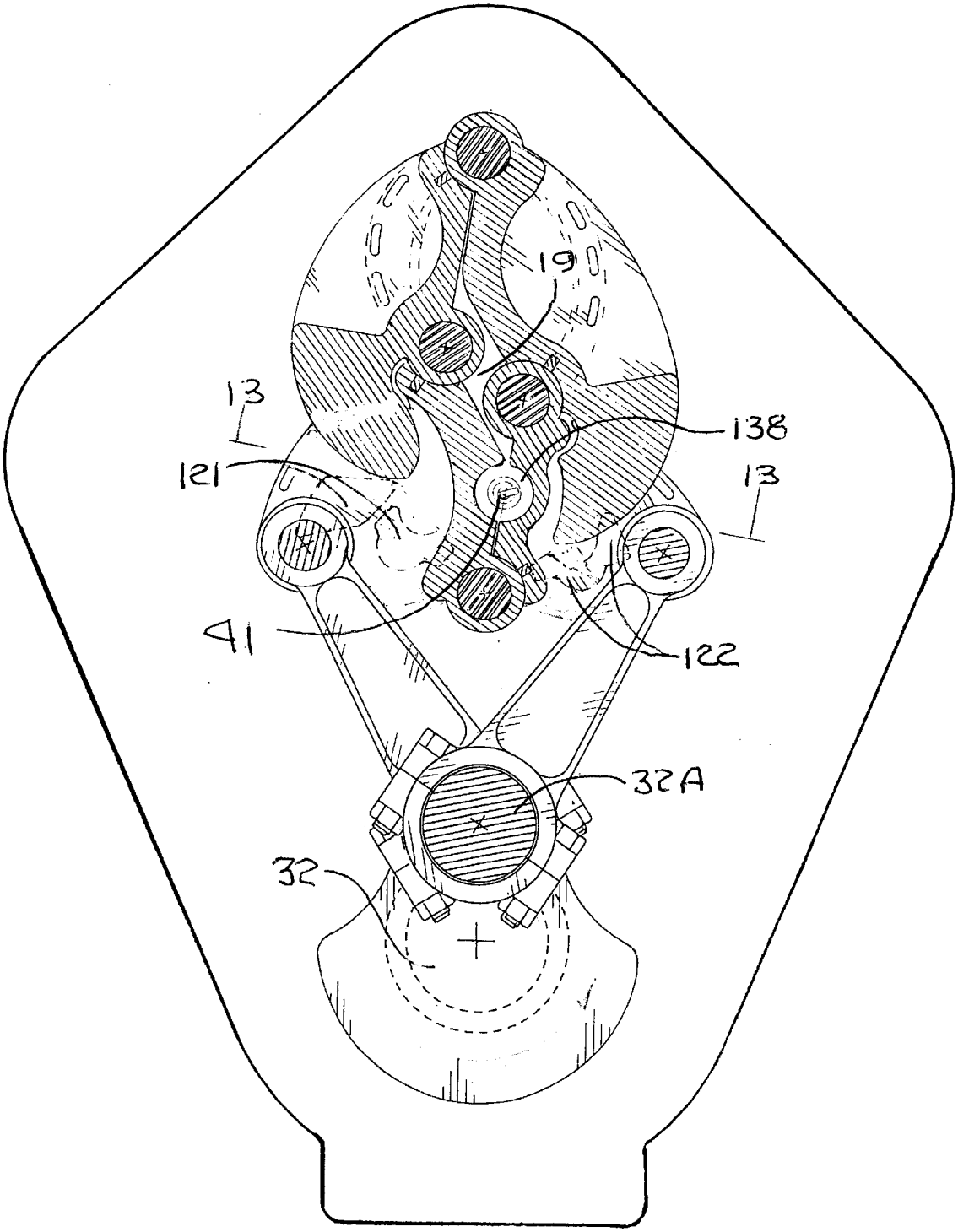
FIG. 12 is a view of a second embodiment of the engine of the present invention having a fixed spark plug.
Figure 13:
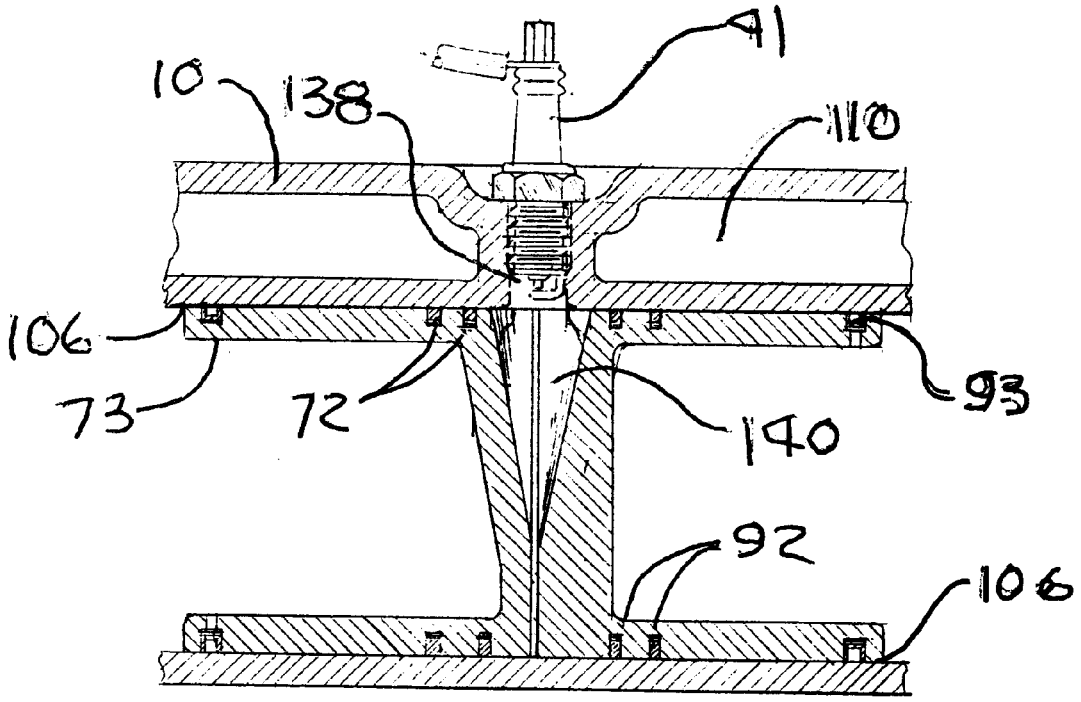
FIG. 13 is a cross section through Line 13—13 of FIG. 12.
Figure 14:
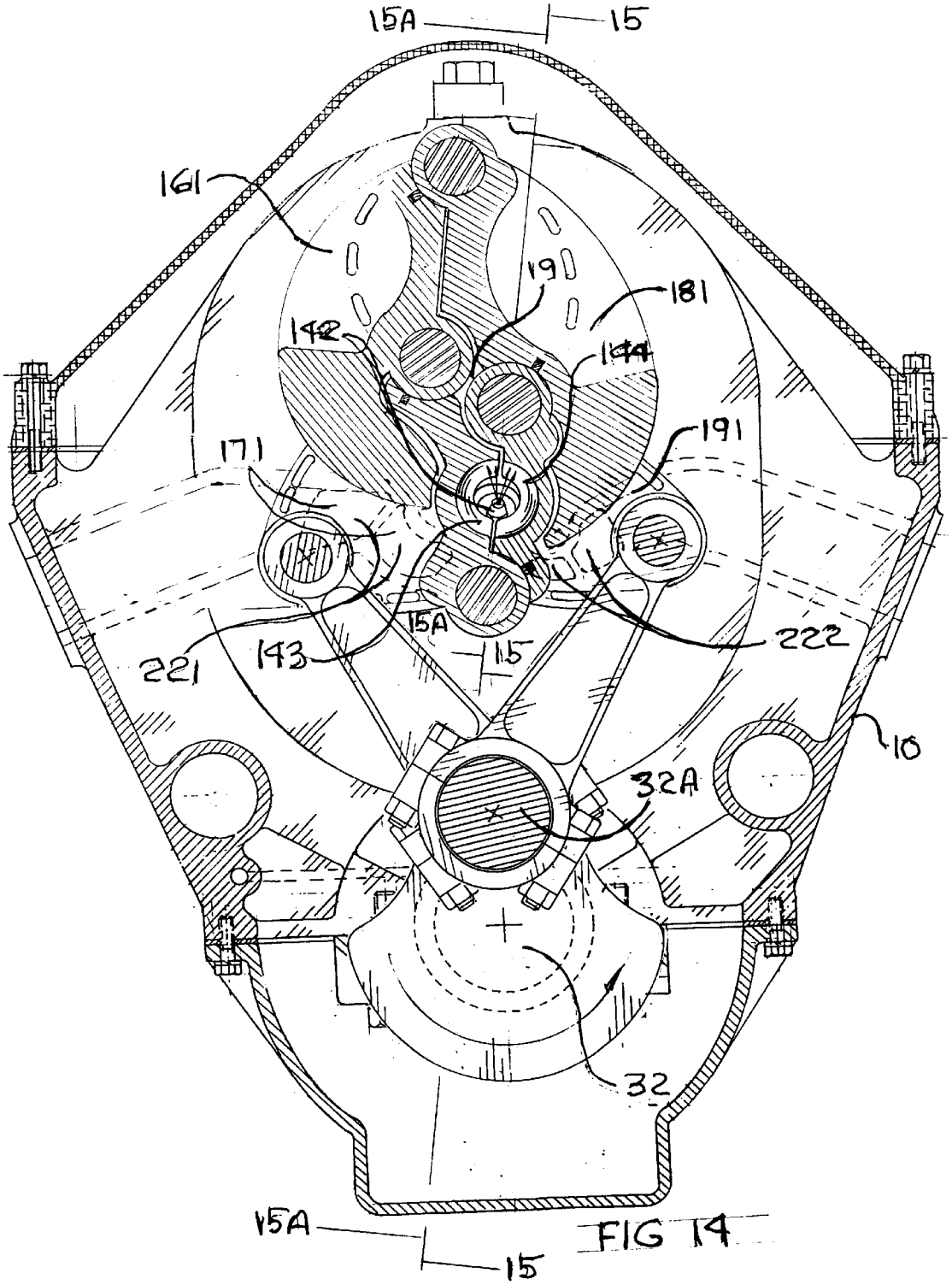
FIG. 14 is a view of a third embodiment of the engine of the present invention shown at a top dead center position.
Figure 15:
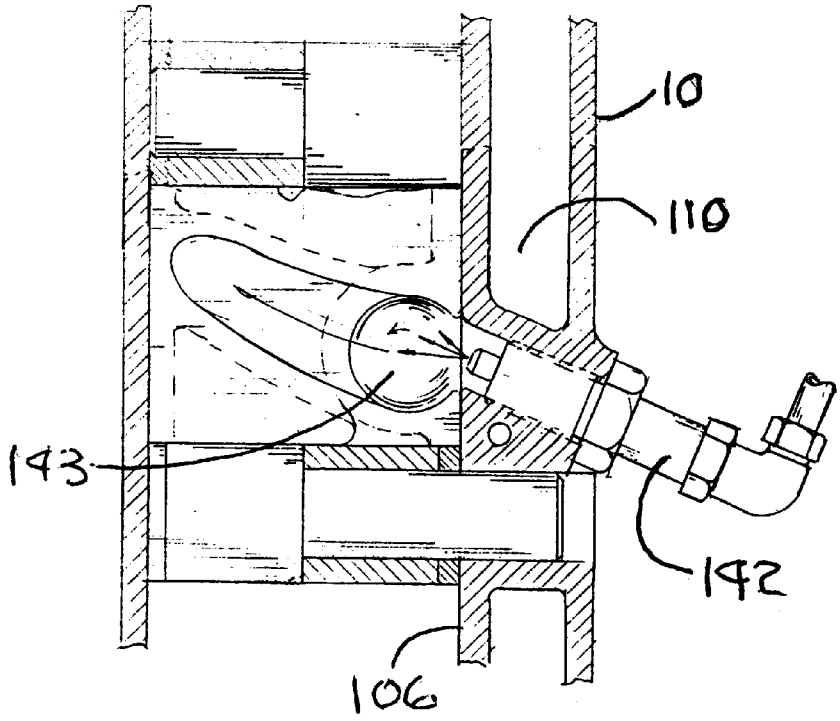
FIG. 15 is a cross section through Line 15—15 of FIG. 14.
Figure 15A:
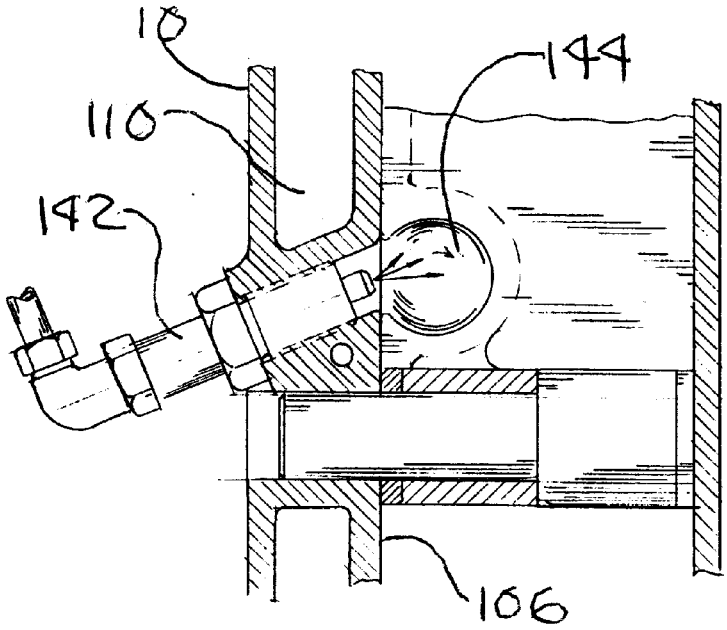
FIG. 15A is a cross section through Line 15A—15A of FIG. 14.

Another embodiment of the invention is shown in FIGS. 12 and 13 by moving the spark plug 41 located in driven vane body assembly 70 to a fixed position in the engine block 10, this passing through the coolant passage 110 into a combustion chamber 138. The new location of the spark plug 41 and combustion chamber 138 will remain inside of the envelope enclosed by the flange oil control rings 63, 73, 83 and 93. This will prevent lubrication from entering the gas control chamber 19 through the combustion chamber 138 and fouling the spark plug 41 and also being consumed in the engine and contributing to unwanted pollution. A tapered channel 140 will provide for flame front travel across the gas control chamber 19. It is to be noted that intake and exhaust ports 121 and 122 are altered to provide for the tapered channel 140 diameter.

In FIGS. 14–17 another embodiment of the present engine is illustrated, a four cycle diesel or compression ignition engine, arranged to provide a more robust assembly with enlarged hinge pins 123 and 124, and hinge bosses.

To be specific, the gas control chamber 19 is modified to provide a higher compression ratio by altering the faces of the vane bodies 161, 171, 181 and 183 as shown, the spark plug 41 and chamber located in vane assembly 60 are deleted and a precombustion chamber 141 and fuel injector 142 known and manufactured as a standard item, to those familiar with the art, are located in the engine block 10 and with the injector body passing through the water passage 110, and directly into a precombustion chamber 143 and 144 in vanes 70 and 90, a cross section of this arrangement being illustrated in view 15 and 15A. It is to be noted that the intake and exhaust ports 221 and 222 will be altered to provide for the aperture of precombustion chambers 143 and 144.

Figure 16:
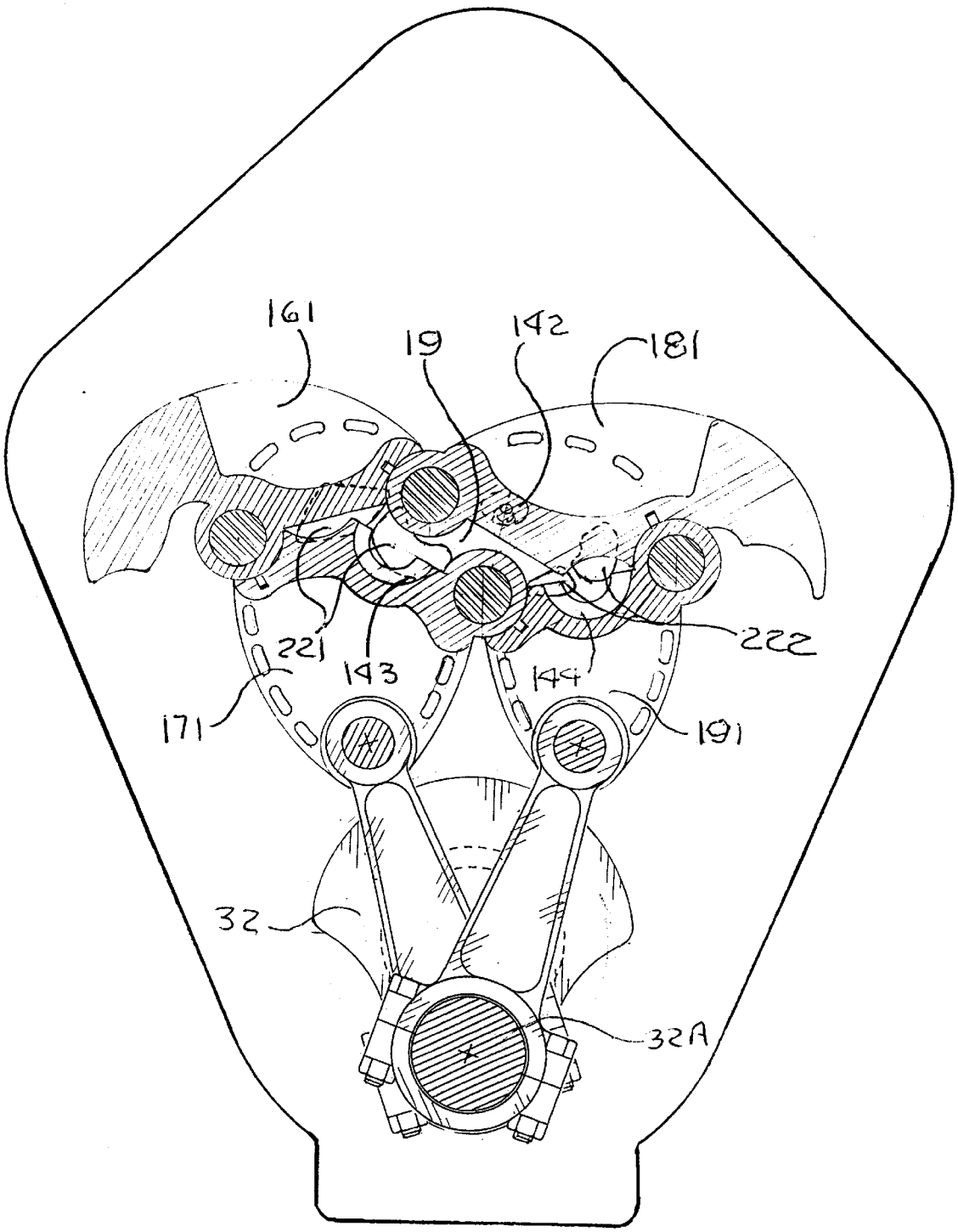
FIG. 16 is a view of the third embodiment of the engine of the present invention shown at a bottom dead center position.
Figure 17:
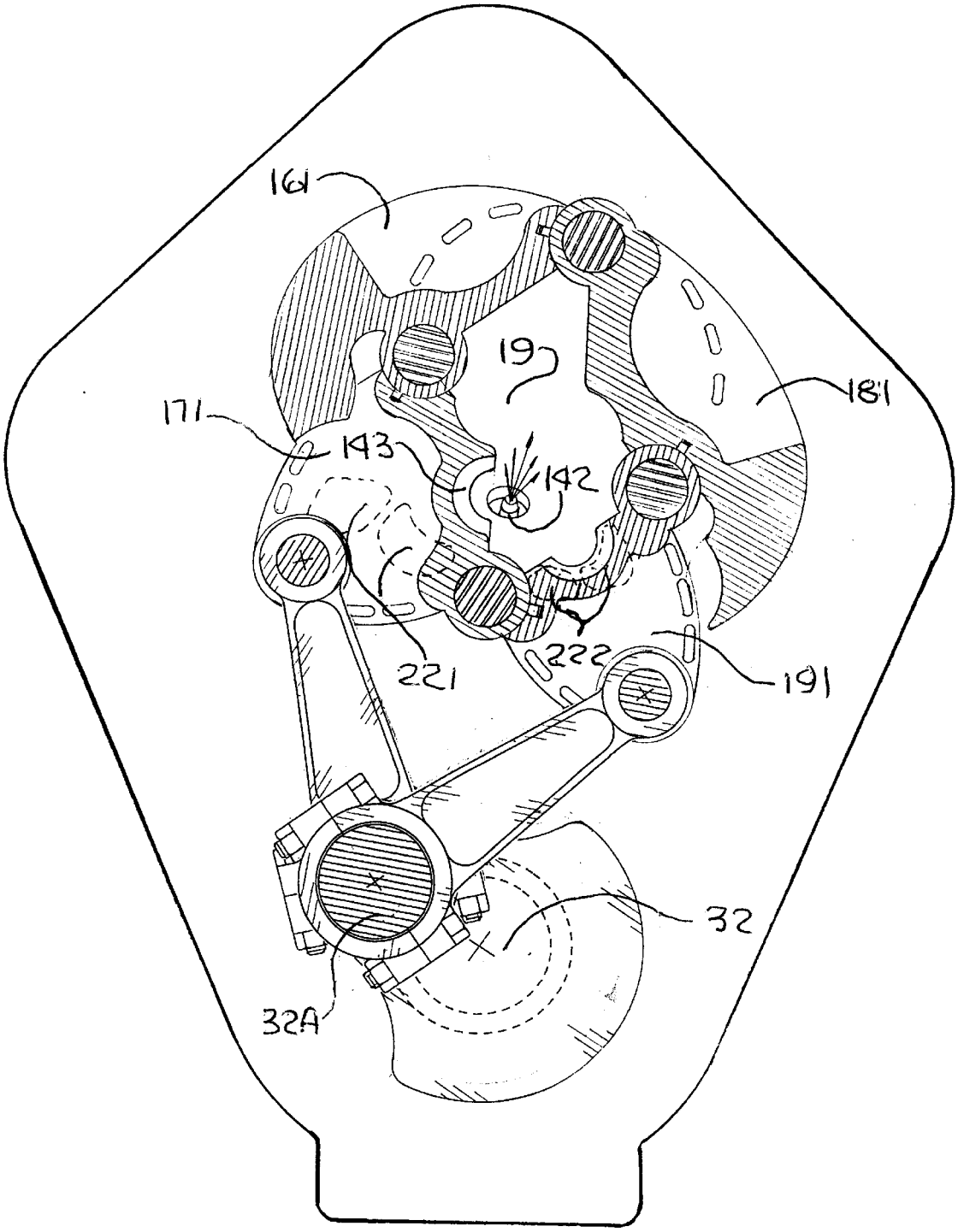
FIG. 17 is a view of the engine of the present invention when the crankshaft is rotated 55 degrees counterclockwise from top dead center.

It is to be noted that the increase in compression ratio obtained by modifying the shape of the vane bodies 161, 171, 181 and 191 as shown will necessitate a larger clearance volume when the gas control chamber 19 when crankpin 32A is rotated to bottom dead center, this is shown in FIG. 16, this will provide for additional scavenging of the exhaust gases by the incoming gas that contains no fuel and this will not affect fuel efficiency. This same improvement in fuel efficiency will also apply to spark ignition engine with direct fuel injection. In FIG. 17 the injector 142 spray pattern into the gas control chamber 19 is shown when the power expansion is partially completed.

In another embodiment of the present invention, an internal combustion engine that completes four cycles in one revolution of the crankshaft is shown in FIGS. 18 through 35. This engine has many advantages, it will have smaller displacements of the components so there will be less acceleration and reduced bearing loadings, also with reduced displacements the seals, substantially the same as shown in FIGS. 9 and 10, will have reduced travel and thereby reduced wear. This new embodiment will also provide for a simple means for changing the compression ratio at any time during the cycle and also varying the extent of the port openings at any time during the four cycles.

Figure 18:
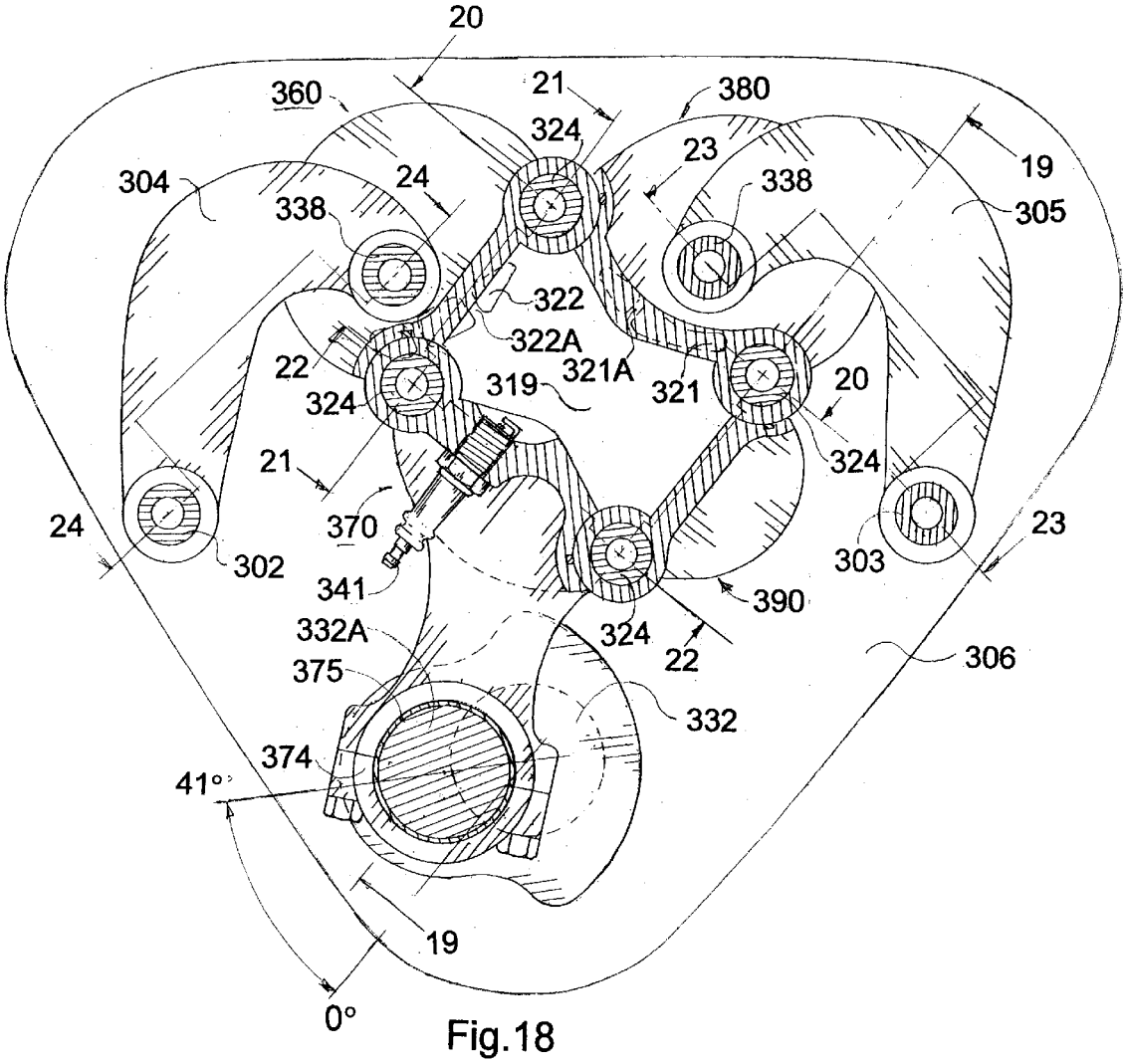
FIG. 18 is a cross sectional view of a fourth embodiment of the present invention with an offset through the center of sparkplug.
Figure 19:
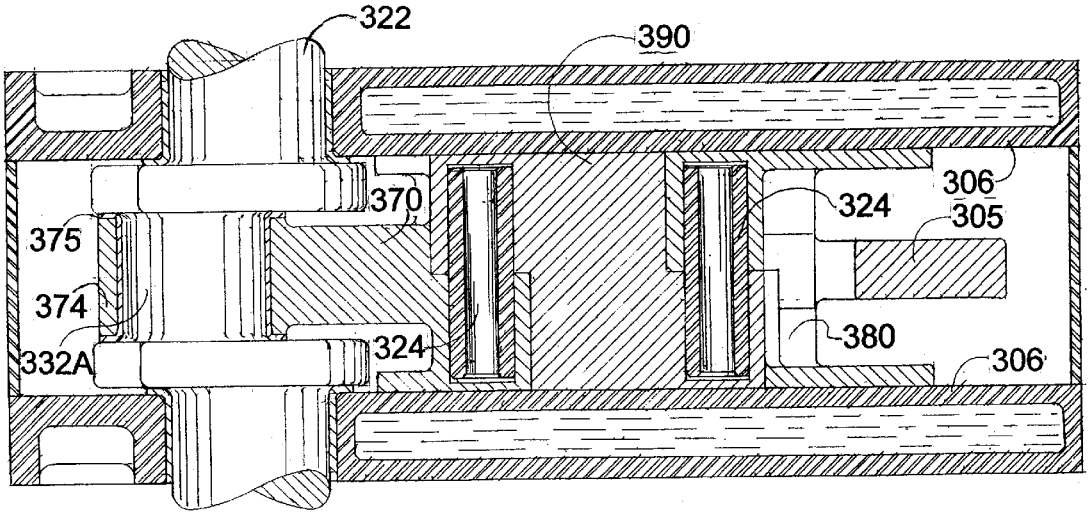
FIG. 19 is a sectional view taken along line 19—19 of FIG. 18.
Figure 20:
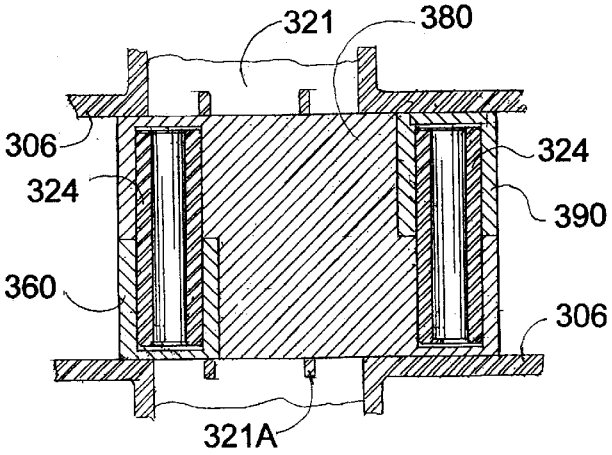
FIG. 20 is a sectional view taken along line 20—20 of FIG. 18.
Figure 21:
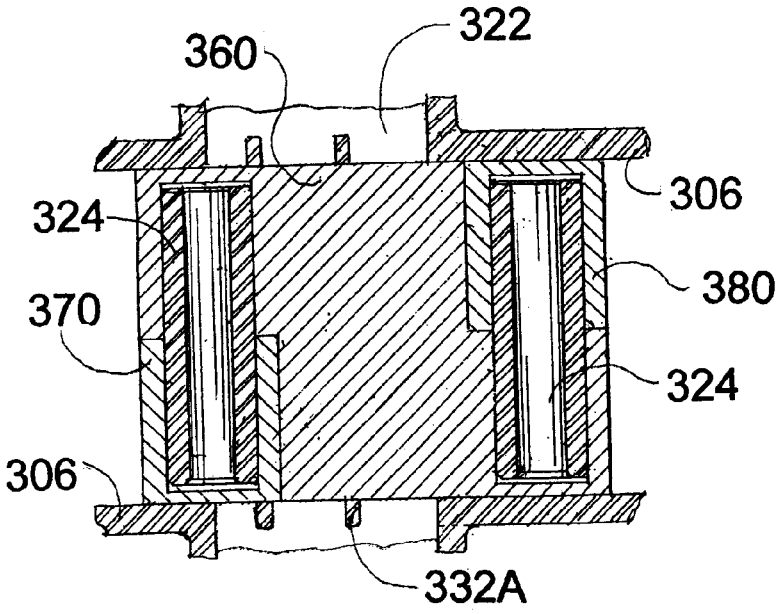
FIG. 21 is a sectional view taken along line 21—21 of FIG. 18.
Figure 22:
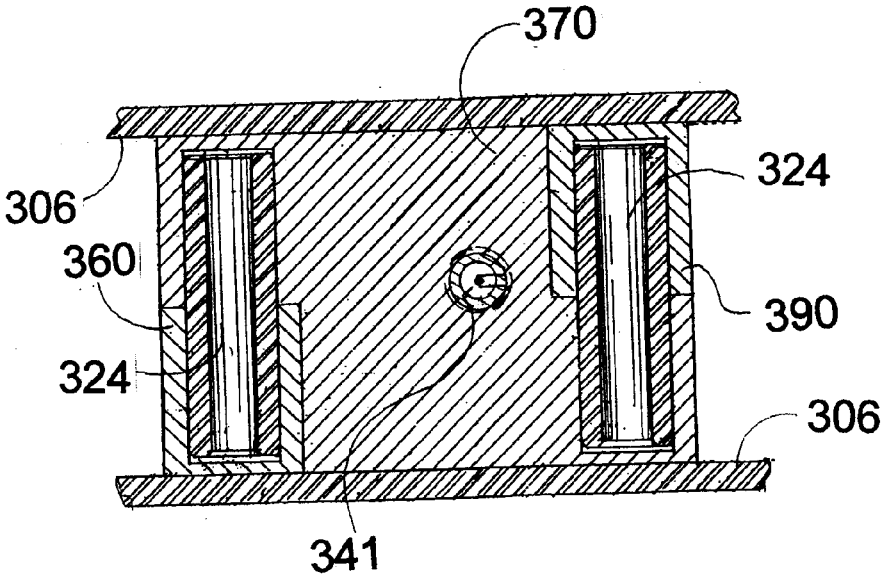
FIG. 22 is a sectional view taken along line 22—22 of FIG. 18.
Figure 23:
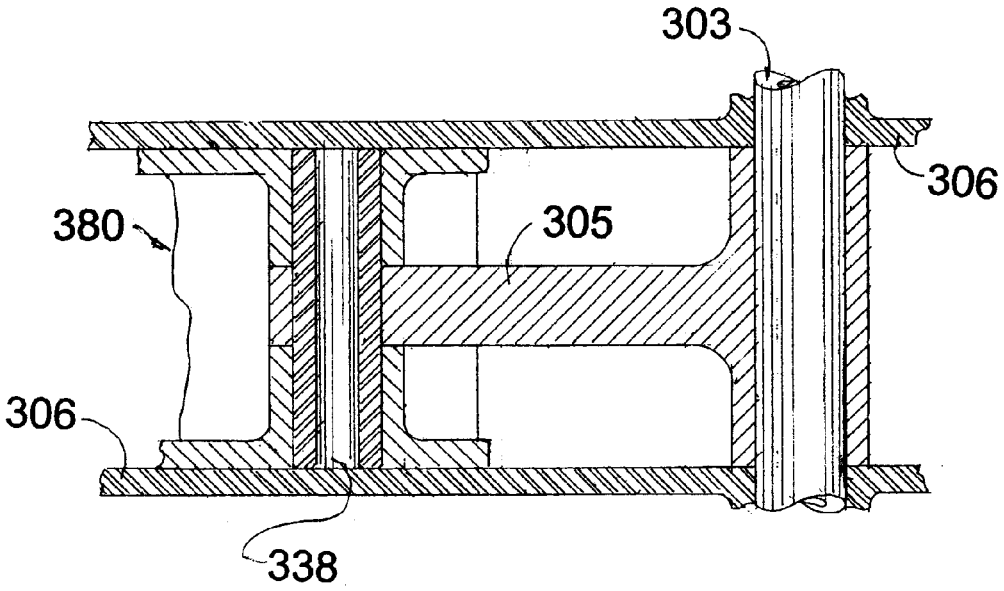
FIG. 23 is a sectional view taken along line 23—23 of FIG. 18.
Figure 24:
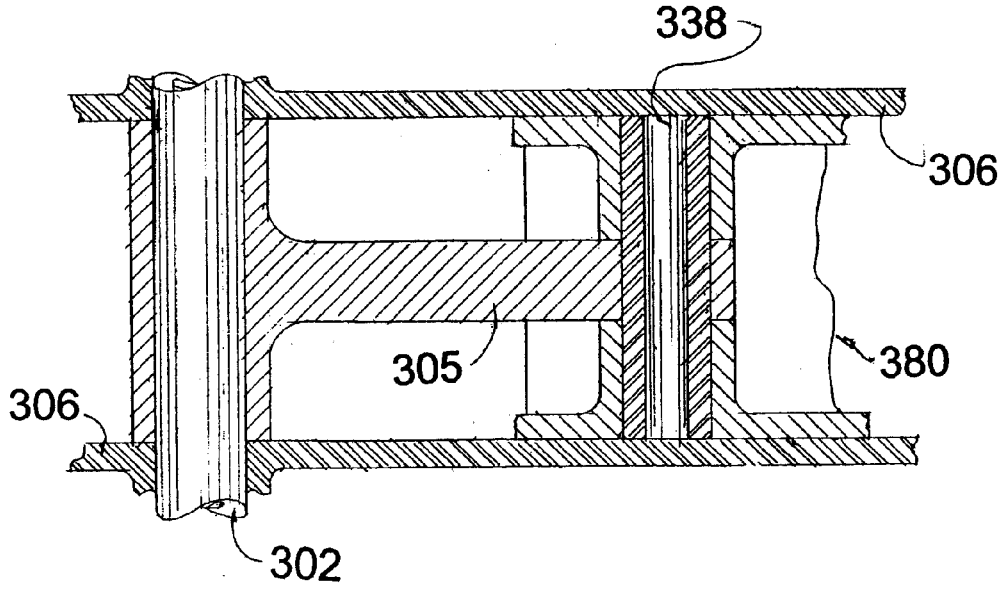
FIG. 24 is a sectional view taken along line 24—24 of FIG. 18.

To be more specific, the engine structure and crankshaft arrangement of FIG. 18 will be substantially as shown in FIGS. 1 and 2, without utilizing the hinge pin 23. As shown in FIGS. 18, 19, 20, 21, 22, 23 and 24 the combustion chamber 319 will be formed by four vanes 360, 370, 380 and 390, and two fixed side walls 306 that are operated in a kinematically different manner from the previous embodiment.

The vane 370, in which the sparkplug 341 is secured will be directly and rotatably connected to crankpin 332A that is part of crankshaft 332 by securing bearing cap 374 with bearing shell 375 interposed. The vane 370 will also be rotatably connected to the two adjacent vanes 360 and 390 with two hinge pins 324. In a similar manner vane 380 will be rotatably attached to the two adjacent vanes 390 and 360 by 2 hinge pins 324. Exhaust port bridge 322A will prevent seals from interfering with exhaust port 322 edges and intake port bridge 321A will prevent seals from interfering with intake port 321 edges.

Link 304 will be rotatively connected to vane 360 with wristpin 338 that is secured in link 304 and will be rotatively connected to link shaft 302 that is located in both opposite side walls 306. In a similar manner, link 305 will be rotatably connected to vane 380 with wrist pin 338 that is secured in link 305 that will be rotationally connected to link shaft 303 that is located in both opposite side walls 306.

Figure 25A:
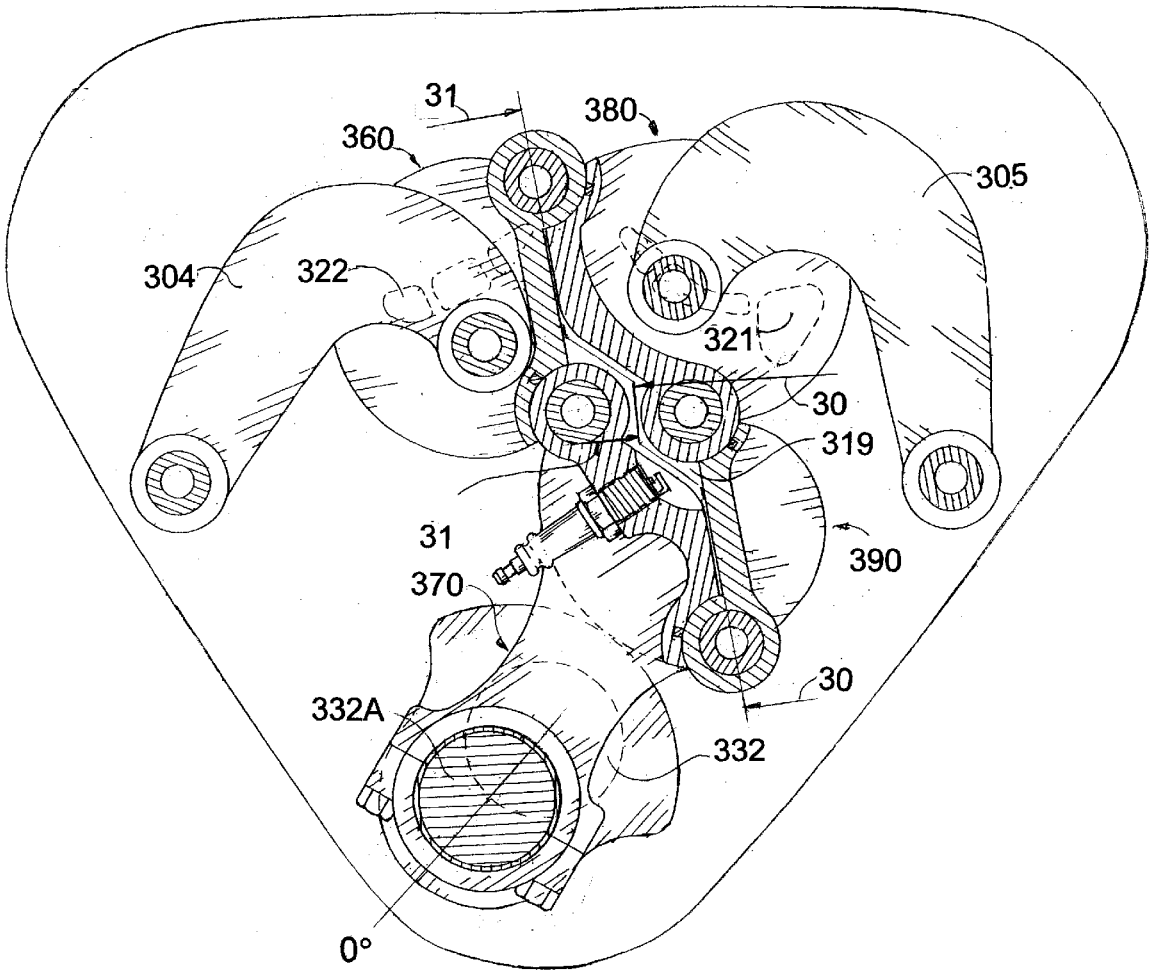
FIG. 25A is a view of the engine shown in FIG. 18 when the crankshaft is at 0 degrees.

FIG. 25A illustrates the combustion chamber 319 that is formed by vanes 360, 370, 380 and 390. The compression cycle has been completed and the combustion chamber 319 volume is at a minimum and the crankshaft 332 and crankpin 332A are at 0 degrees and are rotating clockwise. Ignition of the charged gases has occurred and the combustion or power stroke is about to begin.

Figure 25B:
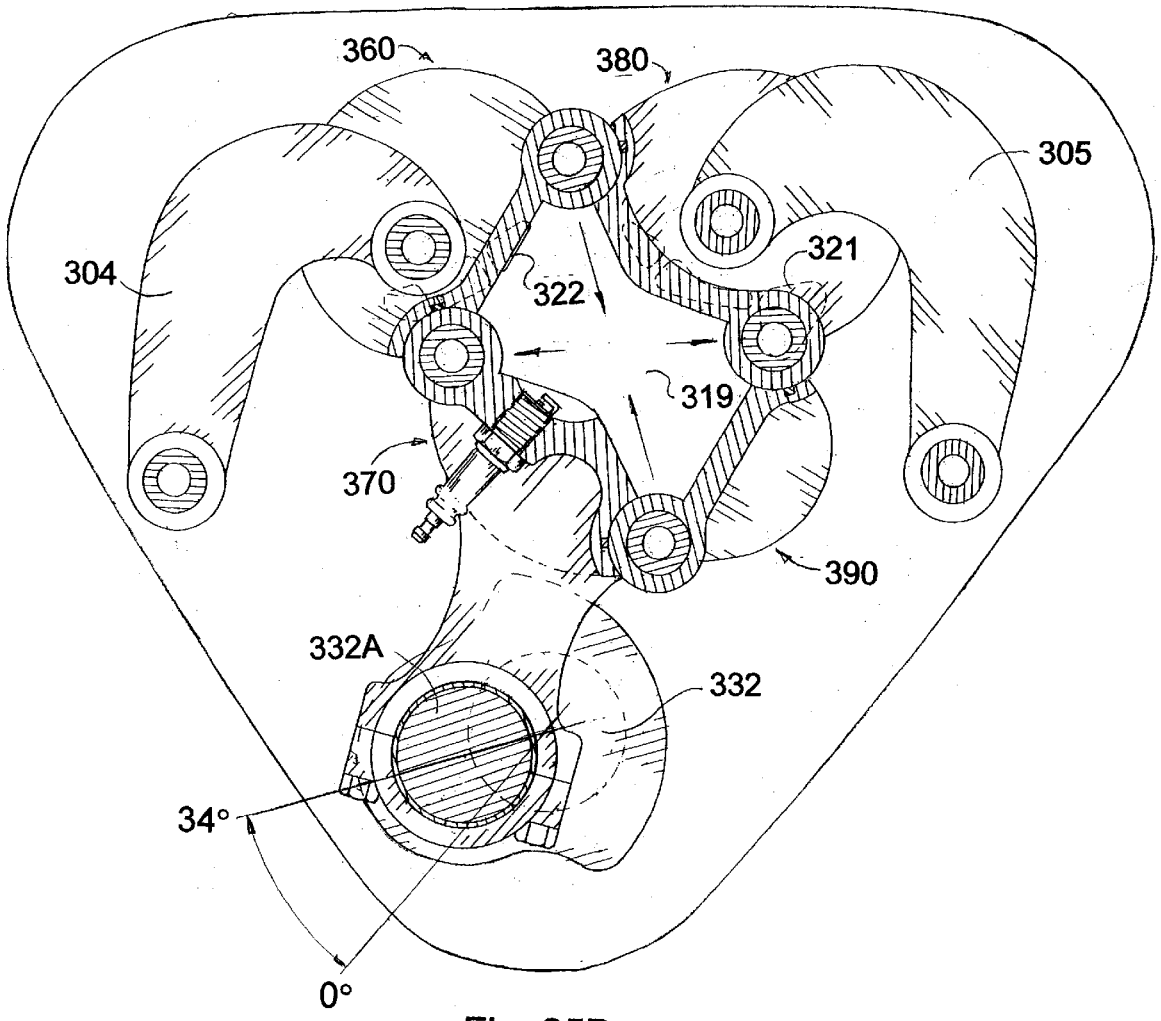
FIG. 25B is a view of the engine shown in FIG. 18 when the crankshaft has revolved clockwise 34 degrees.

In FIG. 25B the crankshaft 332 and crankpin 332A have revolved 34 degrees clockwise caused by the expansion of the combustion gases against the vanes 360, 370, 380 and 390. The short arrows indicate how the burnt gases in the combustion chamber 319 will expand away from the combustion area and the long arrows will show how the charged gases will be fed into the combustion area to reduce flame-front travel. The combustion chamber 319 is now simultaneously approaching a maximum volume and the movement of vane 360 is beginning to uncover the exhaust port 322, to start the exhaust cycle.

Figure 25C:
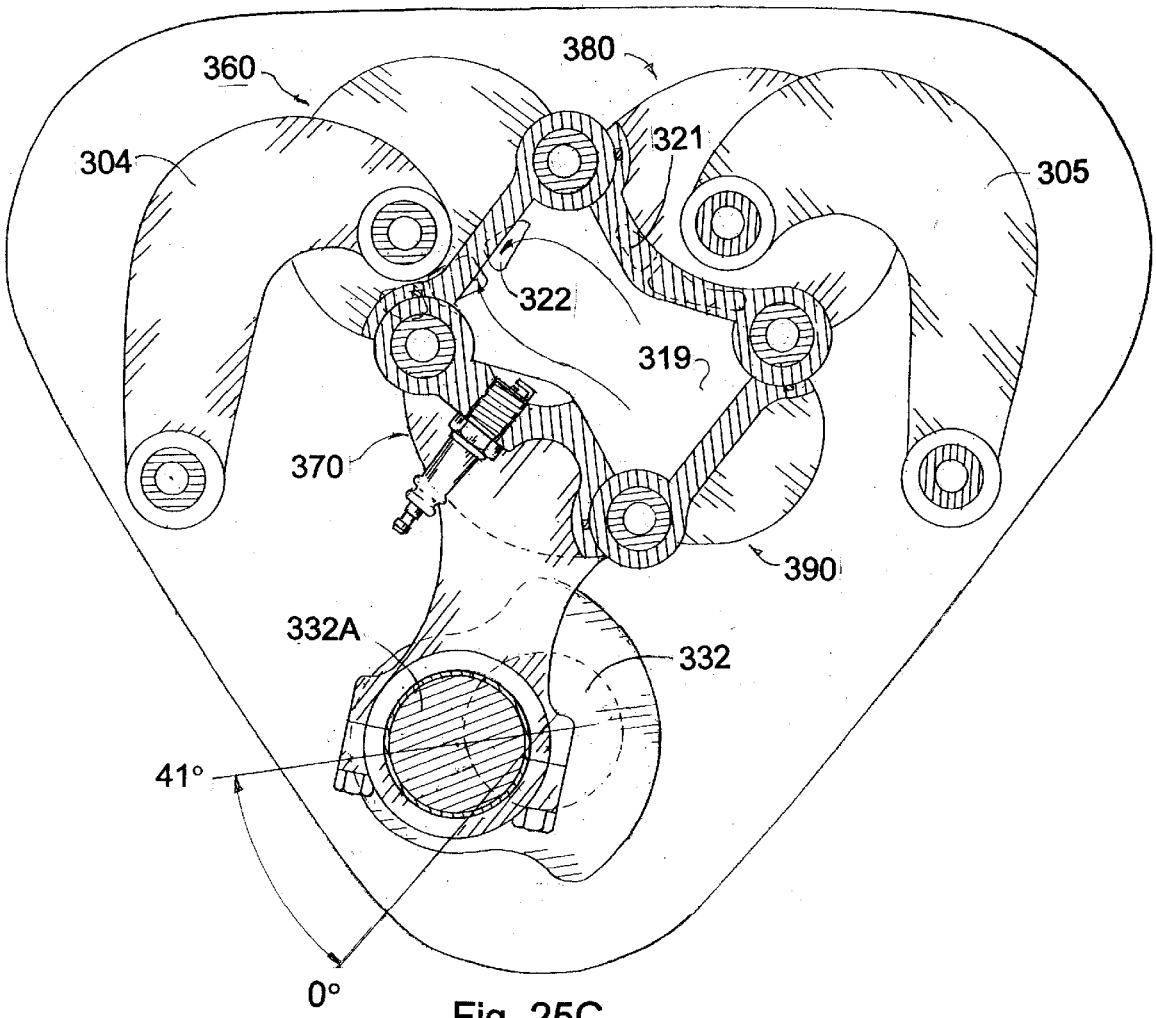
FIG. 25C is a view of the engine shown in FIG. 18 when the crankshaft has revolved clockwise 41 degrees.

In FIG. 25C the crankshaft 332 and crankpin 332A have rotated 41 degrees clockwise. The combustion chamber 319 formed by vanes 360, 370, 380 and 390 is now at the maximum and exhaust port 322 is continuing to open due to the motion of vane 360.

Figure 25D:
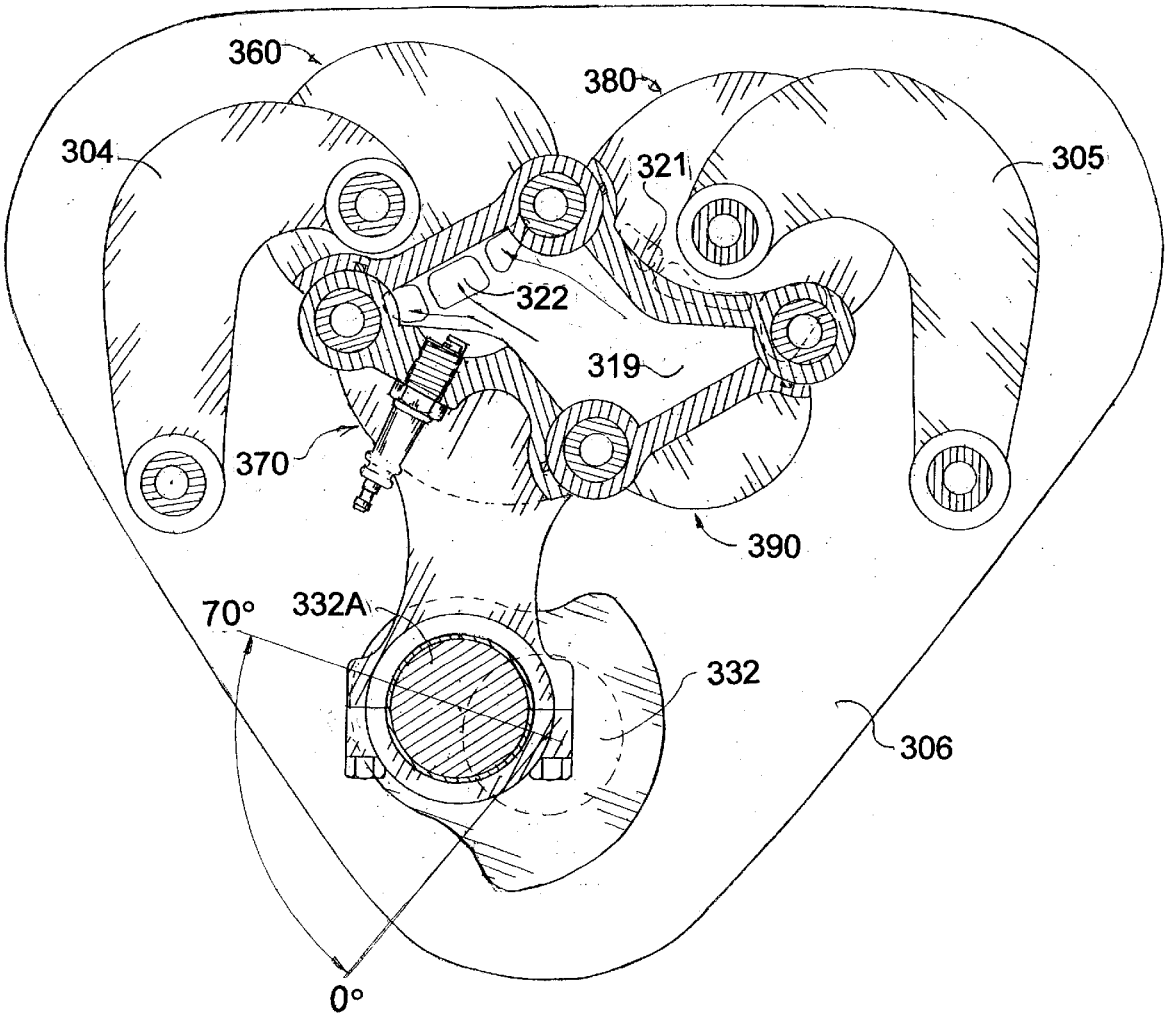
FIG. 25D is a view of the engine shown in FIG. 18 when the crankshaft has revolved clockwise 70 degrees.

In FIG. 25D the crankshaft 332 and crankpin 332A have rotated 70 degrees clockwise and the movement of vane 360 continues to open exhaust port 322 and exhaust port 322 is at a maximum and the exhaust gases are being forced out by the reduction in volume of the combustion chamber 319 formed by vanes 360, 370, 380 and 390.

Figure 25E:
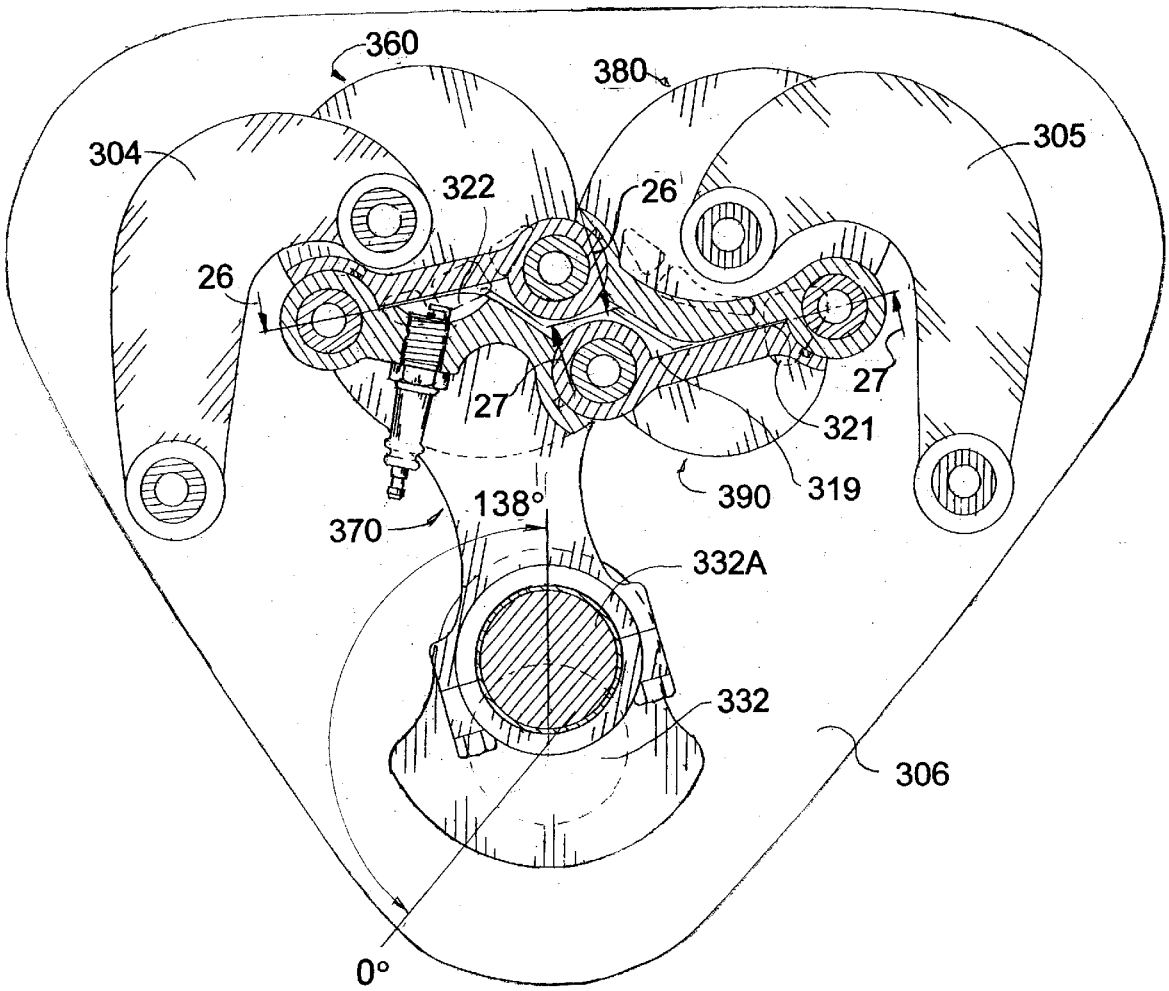
FIG. 25E is a view of the engine shown in FIG. 18 when the crankshaft has revolved clockwise 138 degrees.
Figures 26, 27, 28, 29:
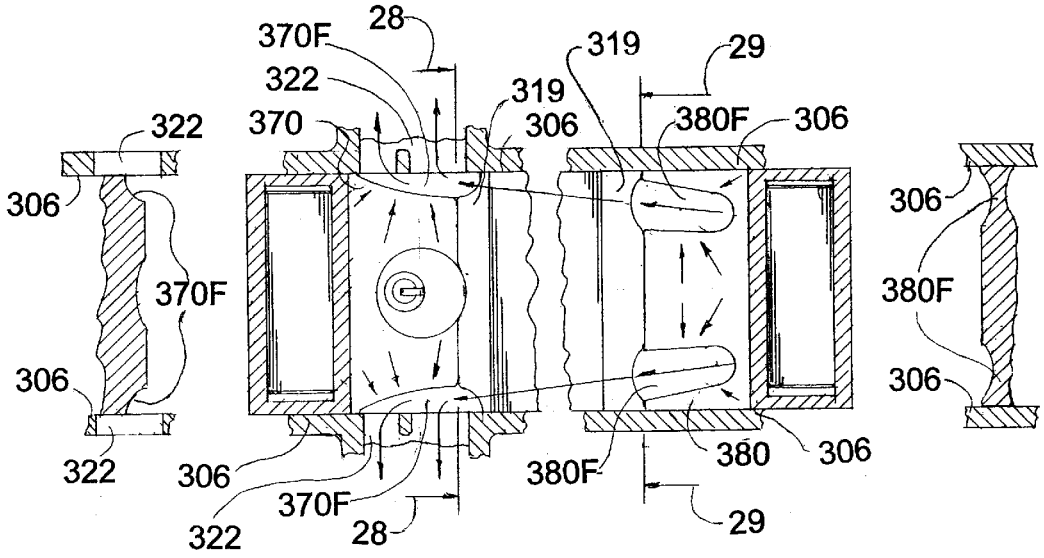
FIG. 26 is a view taken along line 26—26 of FIG. 25E.
FIG. 27 is a view taken along line 27—27 of FIG. 25E.
FIG. 28 is a scrap view taken along line 28—28 of FIG. 26.
FIG. 29 is a scrap view taken along line 29—29 of FIG. 27.

In FIG. 25E the crankshaft 332 and crankpin 332A have rotated 138 degrees, the exhaust port 322 is almost completely closed by vane 360 and 370, and the intake port 321 is beginning to open due to the motion of vanes 380 and 390, the combustion chamber 319 is now at a minimum volume also shown in FIGS. 26 and 27 and scavenging of the exhaust gases is starting, this will end the exhaust cycle and begin the intake cycle.

Figure 25F:
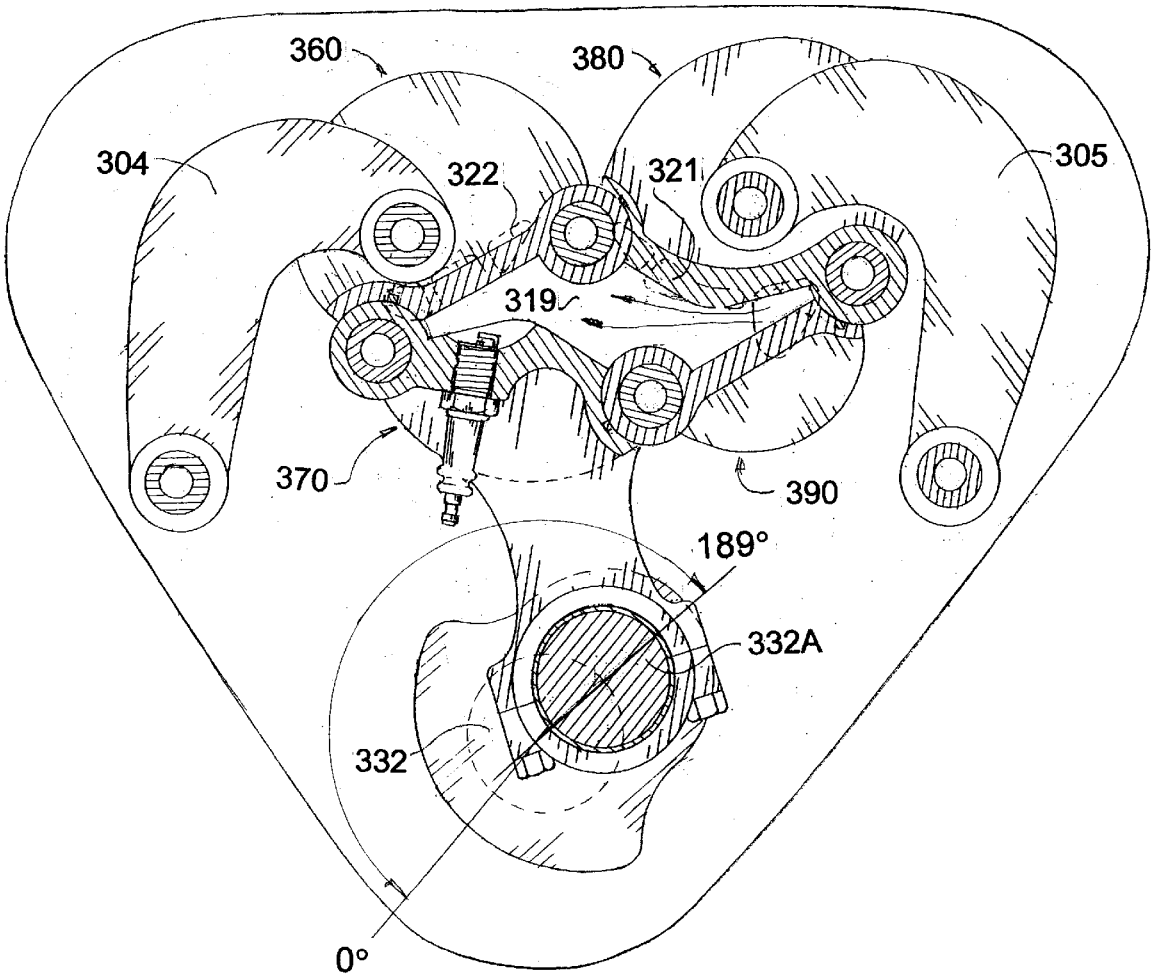
FIG. 25F is a view of the engine shown in FIG. 18 when the crankshaft has revolved clockwise 189 degrees.

In FIG. 25F the crankshaft 332 and crankpin 332A have rotated 189 degrees and the exhaust port 322 is completely closed by vane 360 and the intake port 321 is being uncovered by the movement of vanes 380 and 390, the combustion chamber formed by vane 360, 370, 380 and 390 is continuing to increase in volume bringing intake gases into the combustion chamber 319.

Figure 25G:
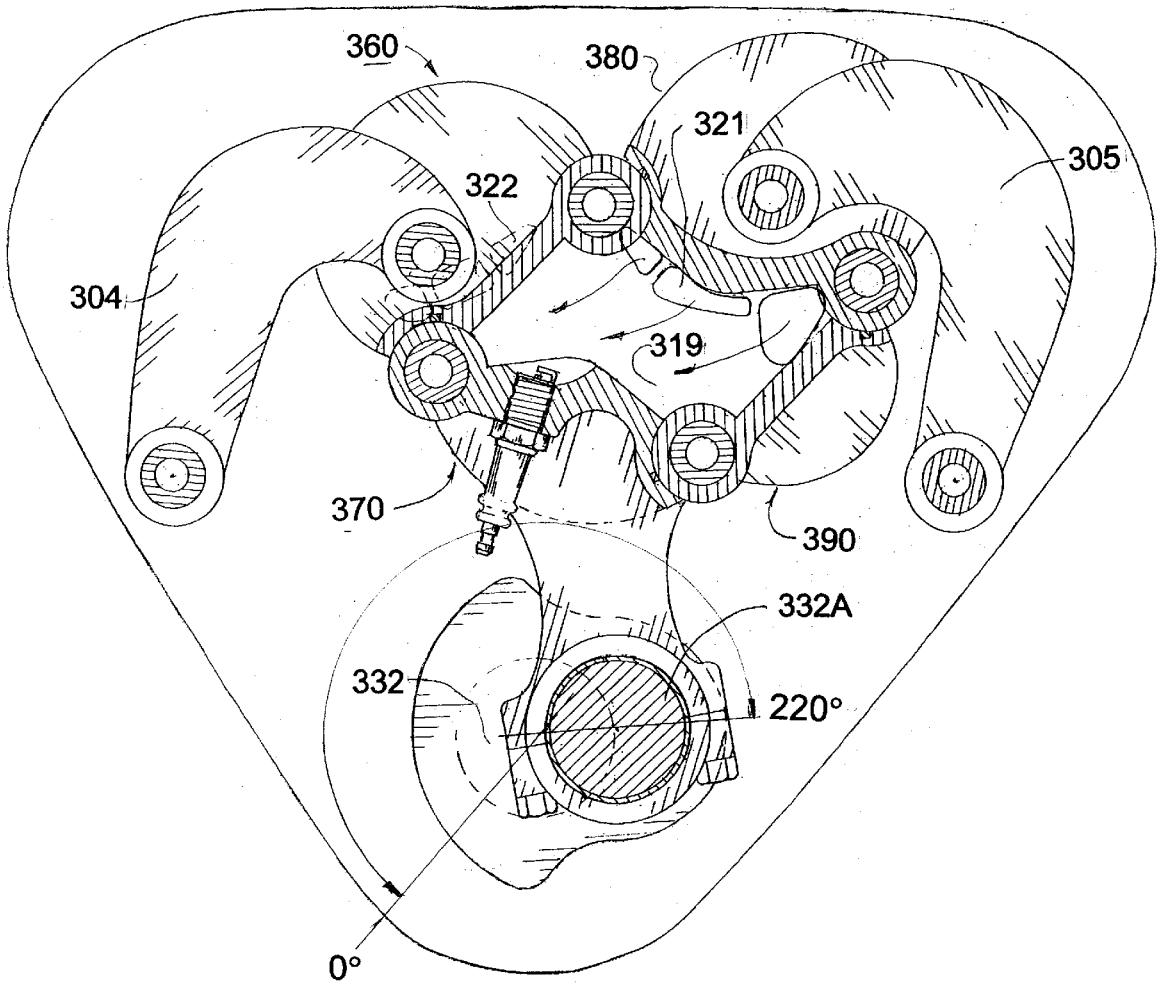
FIG. 25G is a view of the engine shown in FIG. 18 when the crankshaft has revolved clockwise 220 degrees.

In FIG. 25G the crankshaft 332 and crankpin 332A have rotated 220 degrees and the intake port 321 is at maximum opening. The combustion chamber 319 formed by vane 360, 370, 380 and 390 continues to increase in volume bringing intake charged gases as shown by arrows into the chamber.

Figure 25H:
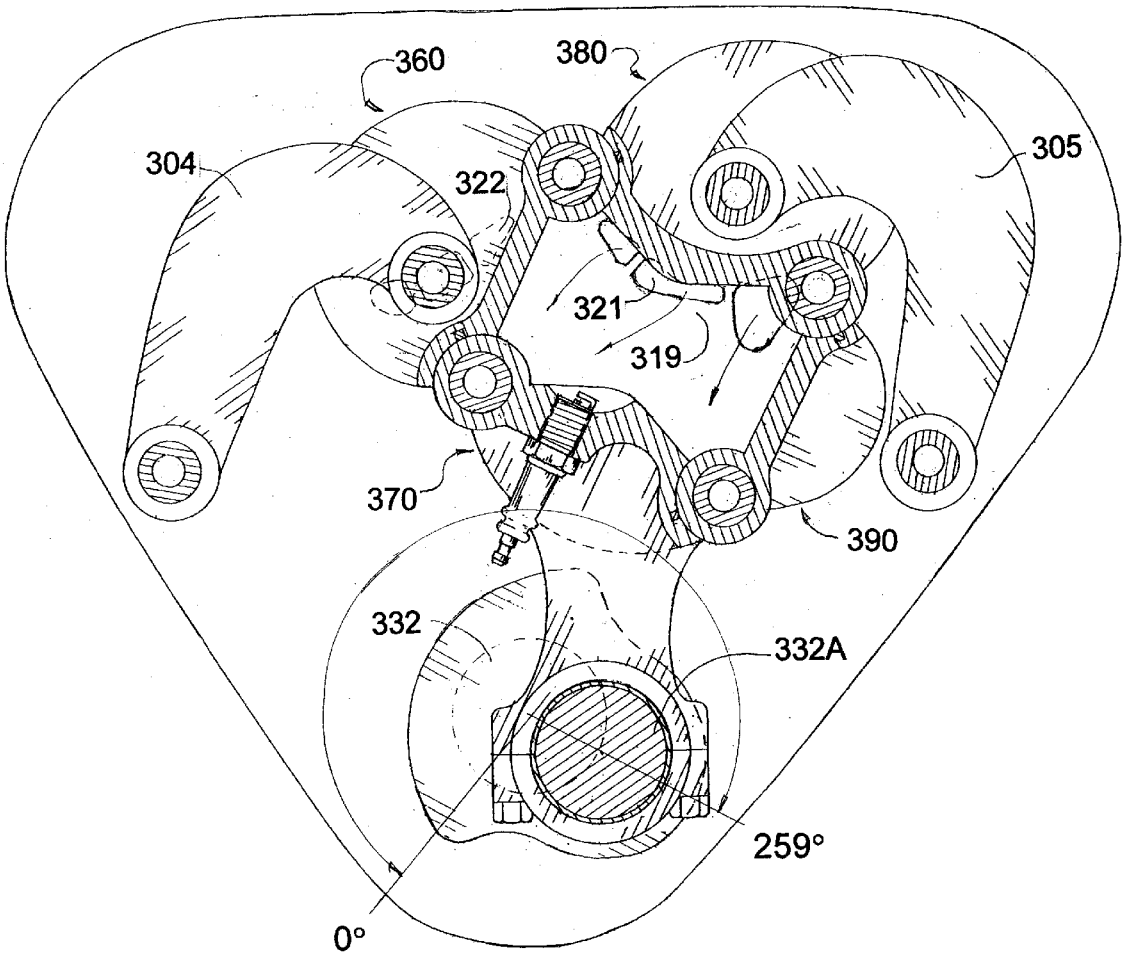
FIG. 25H is a view of the engine shown in FIG. 18 when the crankshaft has revolved clockwise 259 degrees.

In FIG. 25H the crankshaft 332 and crankpin 332A have rotated 259 degrees, the combustion chamber 319 formed by vanes 360, 370, 380 and 390 is now at maximum volume and the impulse of the charged gases through the intake port 321 will continue to fill the combustion chamber 319 as shown by arrows.

Figure 25J:
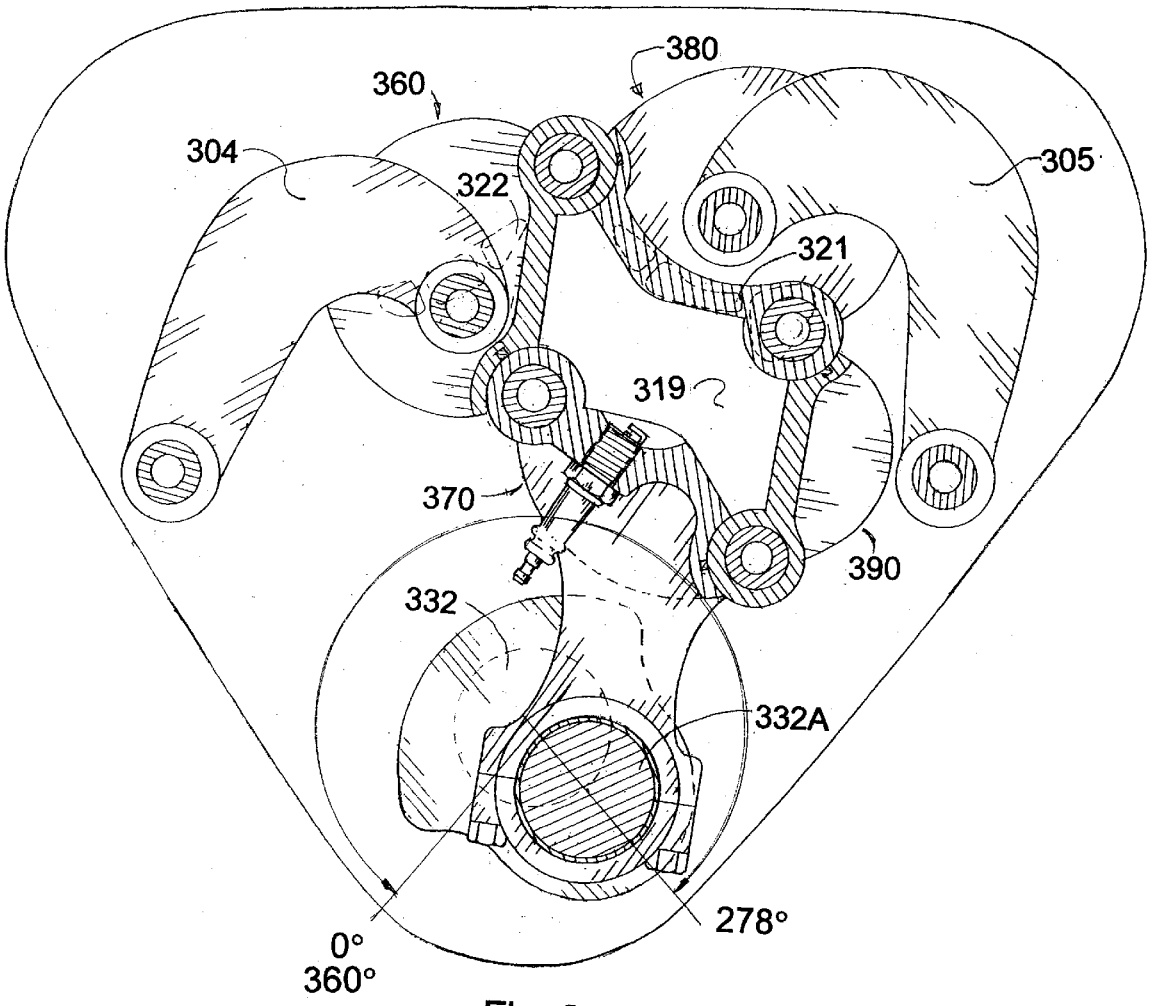
FIG. 25J is a view of the engine shown in FIG. 18 when the crankshaft has revolved clockwise 278 degrees.

In FIG. 25J the crankshaft 332 and crankpin 332A have rotated 278 degrees, the intake port 321 and exhaust port 322 are both closed and the combustion chamber 319 formed by vanes 360, 370, 380 and 390 is decreasing in volume to begin the compression cycle.

Figure 25K:
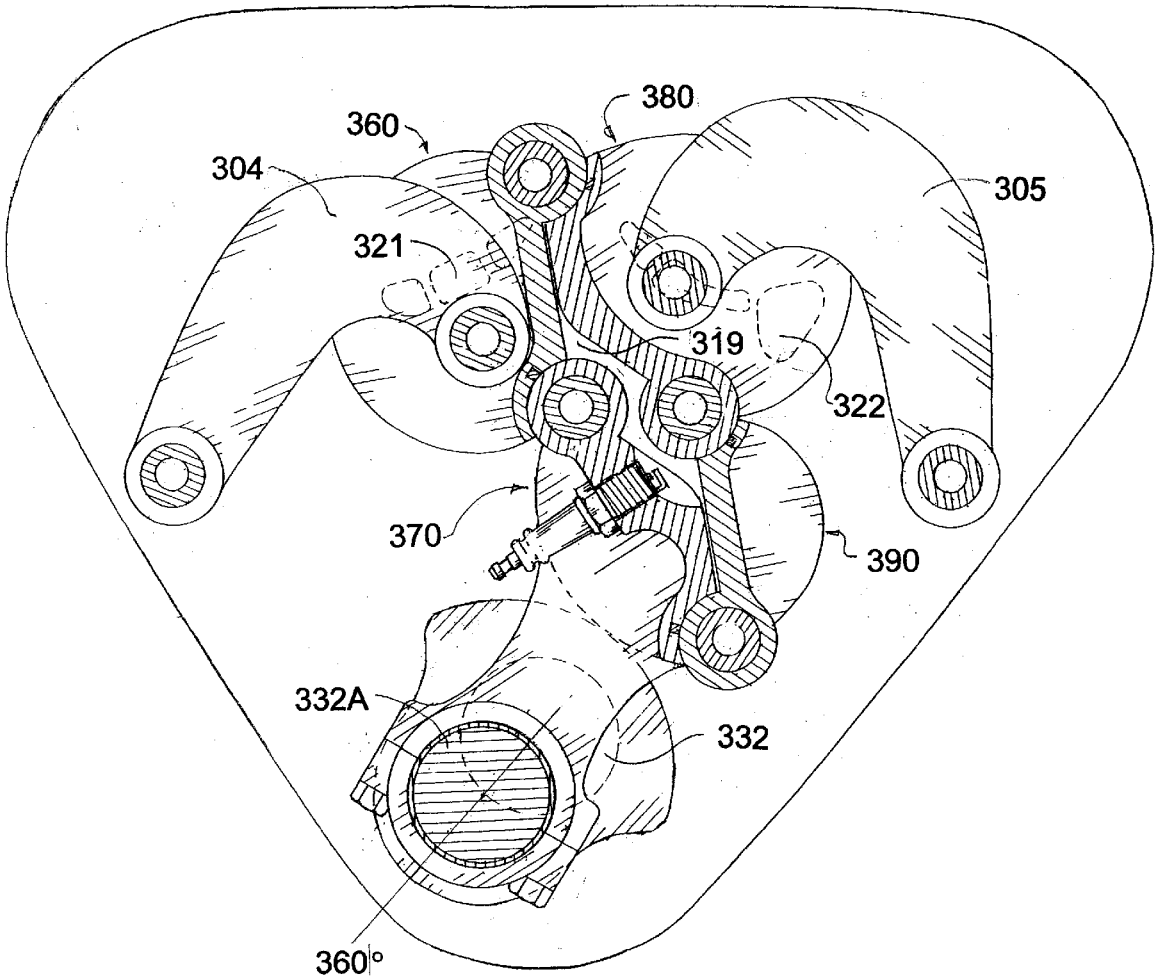
FIG. 25K is a view of the engine shown in FIG. 18 when the crankshaft has revolved clockwise 360 degrees.

In FIG. 25K the crankshaft 332 and crankpin 332A have rotated 360 degrees back to the starting point which is also 0 degrees and the combustion chamber formed by vanes 360, 370, 380 and 390 is at a minimum and the intake gases will be compressed to maximum and ignition will occur and the crankshaft will continue to rotate to start the combustion or power stroke.

FIG. 26 is a view along line 26 of FIG. 25E placed adjacent to FIG. 27 which is taken on Line 27 of FIG. 25E and placed in line in appropriate position to more clearly illustrate how the exhaust gases will be projected out of the exhaust port 322. As the exhaust gases are being squeezed out between the opposing faces of vanes 360 and 370 they will be projected as shown by the small arrows, into the channel 370F which is shown in FIG. 28. In a similar manner as shown in FIG. 27, the exhaust gases will be squeezed between the faces of the vanes 390 and 380 forcing the exhaust gases into a channel 380F shown in FIG. 29 and the gases in channels 380F will be projected across the combustion chamber 319 towards the duct 370F to sweep the exhaust gases out and into the exhaust port 322. This pulse of velocity imparted to the exhaust gases will continue to promote flow of the intake gases thereby improving the scavenging of the combustion chamber 319.

Figures 30, 31:
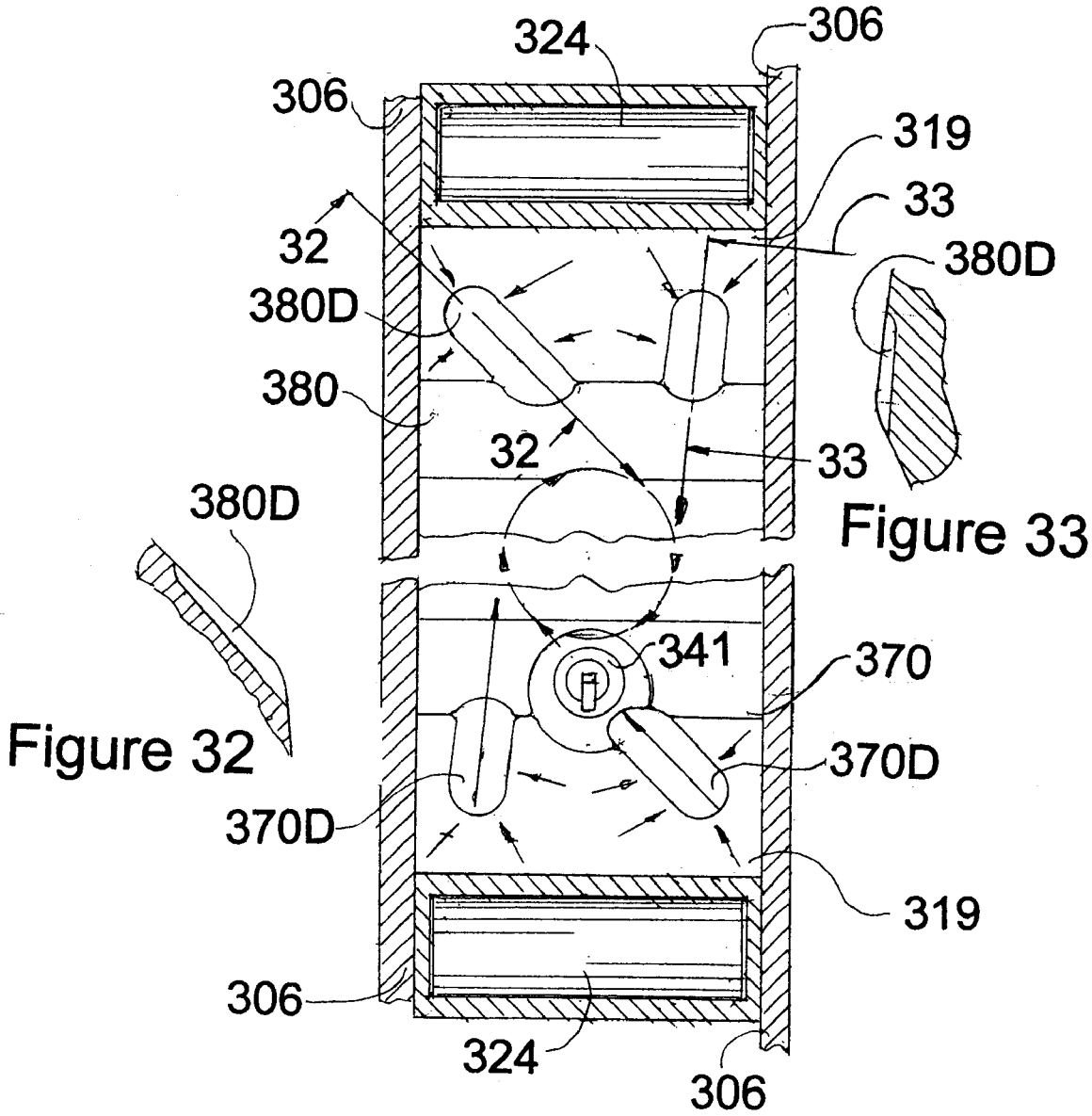
FIG. 30 is a view taken along line 30—30 of FIG. 25A.
FIG. 31 is a view taken along line 31—31 of FIG. 25A.

Shown in FIG. 30 is a view along line 30 of FIG. 25A and placed adjacent to FIG. 31 taken on line 31 of FIG. 25A and in approximate position to more clearly illustrate how a swirl will develop across the combustion chamber 319. As the gases are squeezed between the 2 opposite faces of vanes 370 and 390, the short arrows indicate how intake gases will be forced into the 2 channels 370D that are similar in cross section to channels 38D shown in FIGS. 33 and 32, in a similar way gases squeezed between face 380 and 360 as shown by short arrows will be squeezed into the two channels 380D shown in FIGS. 33 and 32. As the squeezing continues, the compressed gases will be projected out of the channels 370D as shown by long arrows to produce a swirl pattern indicated by circular arrows. This swirl will produce better mixture of the combustion of gases, and the charged gases will impinge on the area already ignited by spark plug 341 to spread the flame front. It is to be appreciated that rotation swirl across the chamber will accelerate as the distance across the combustion chamber 319 in the direction of swirl will decrease and therefore the moment of momentum will be conserved, as an ice skater spins faster as she pulls her arms in while spinning. This will provide mixing of the combustion gases until the combustion cycle ends.

Figure 34A:
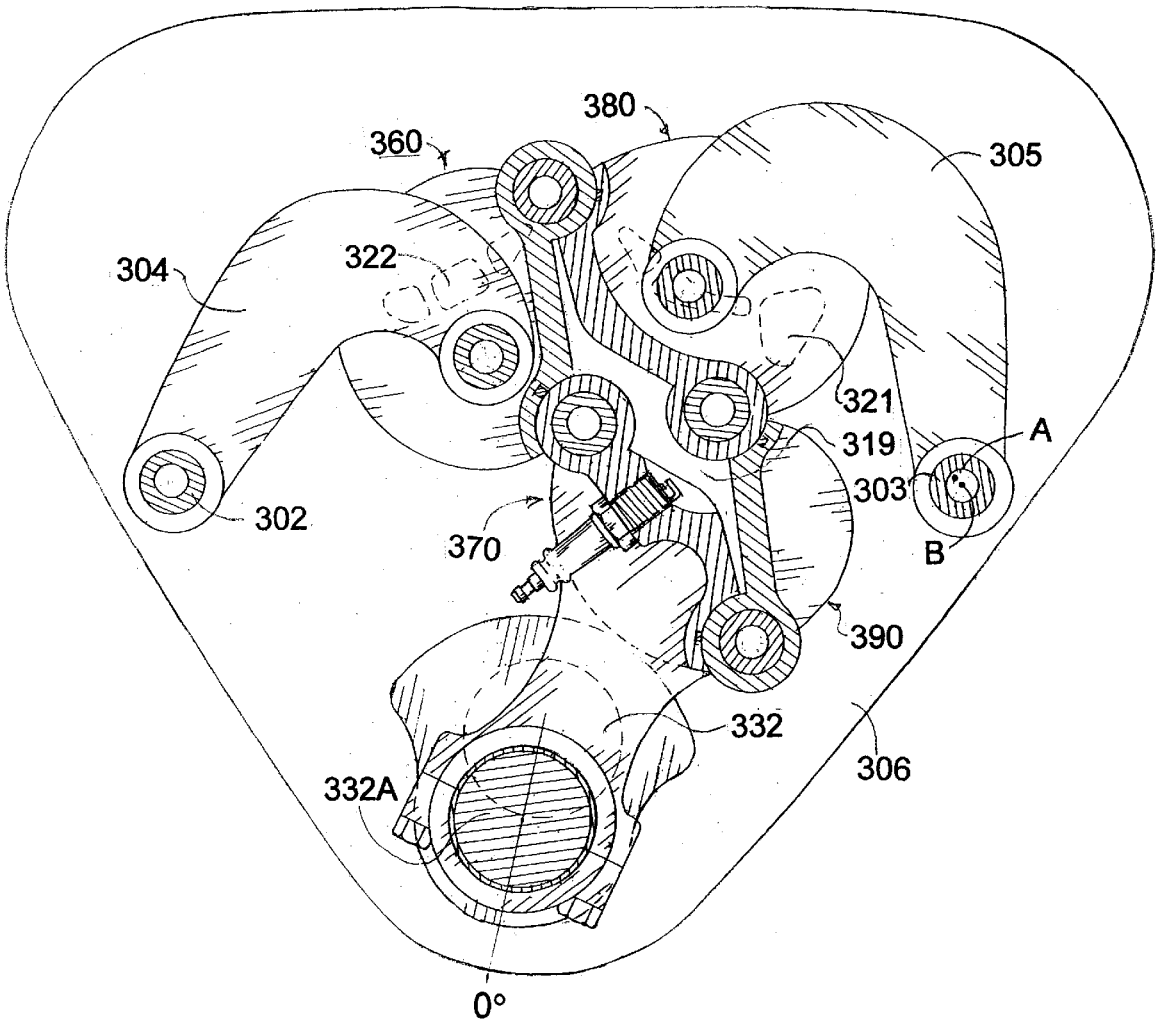
FIG. 34A is a view similar to that of FIG. 25A with a link shaft shifted.

Shown in FIG. 34A is a procedure for reducing the compression ratio of the combustion chamber 319 formed by vane 360, 370, 380 and 390 by displacing link 305 by shifting the shaft 303 from A to B.

Figure 34B:
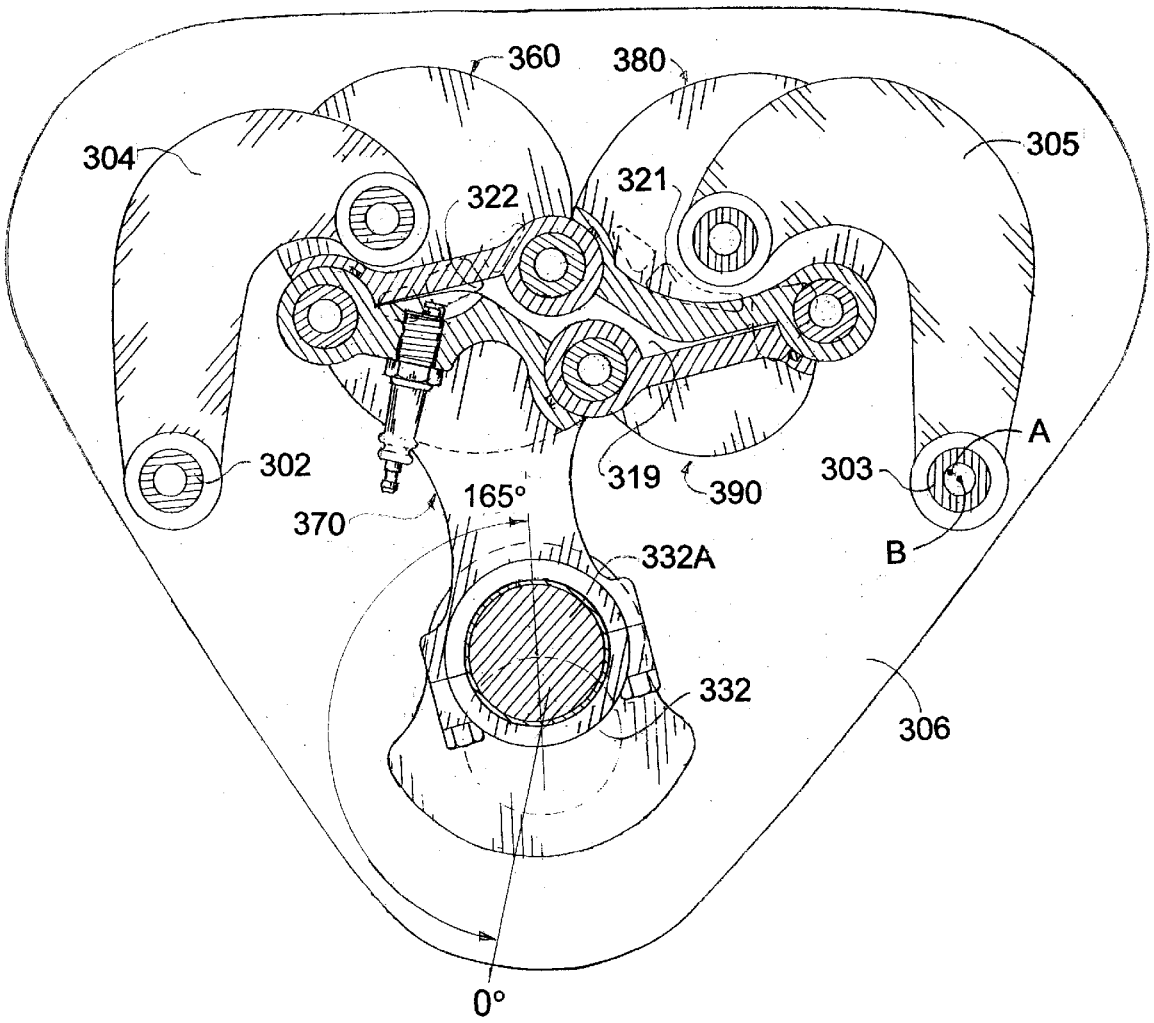
FIG. 34B is a view similar to that of FIG. 25E with a link shaft shifted.

FIG. 34B shows the crank shaft 332 and crankpin 332A rotated 165 degrees with the link 305 link shaft 303 shifted from A to B with no substantial increase in the combustion chamber volume 319 therefore the shift A to B reducing compression ratio can take place at any time during the four cycles without interference between the vanes 360, 370, 380 and 390.

Figure 35A:
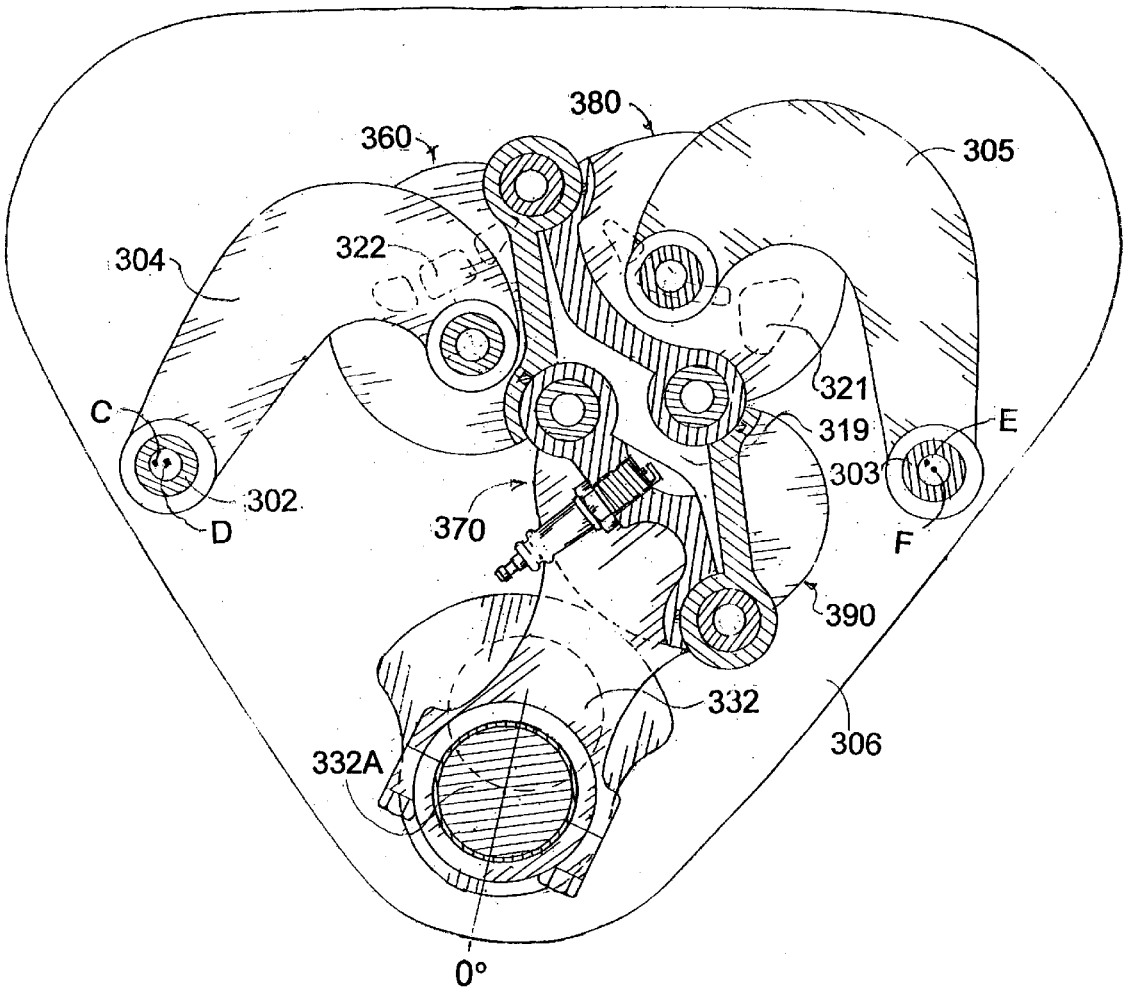
FIG. 35A is a view similar to that of FIG. 25G with two link shafts shifted.

Illustrated in FIG. 35A is a procedure for reducing the maximum size of the intake port 321, by having means to displace the link shafts 302 and 303 at a rate equal to the displacements C to D and E to F, respectively. The portion of the intake port that is covered by vane 380, is reduced and the duration of the opening of the intake port 321 is also reduced promoting higher intake gas velocity, at lower rotation speeds, to provide smoother and more economical operation.

Figure 35B:
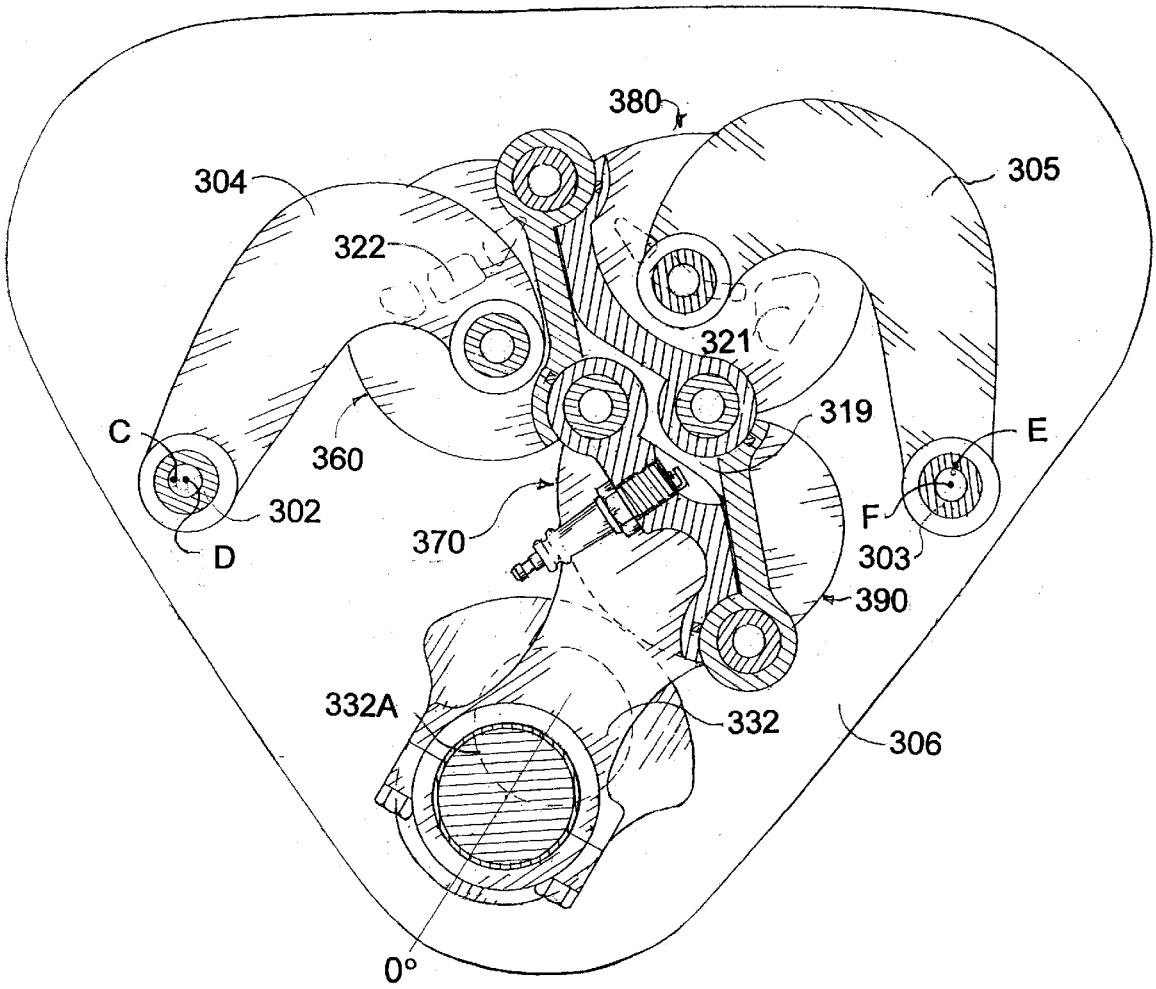
FIG. 35B is a view similar to that of FIG. 25A with two link shafts shifted.

As shown in FIG. 35B with link shaft 302 shifted from C to D and link shaft 303 shifted from E to F, there will be no substantial change in compression ratio determined by the volume of the combustion chamber 319 that is formed by vanes 360, 370, 380 and 390.

Figure 35C:
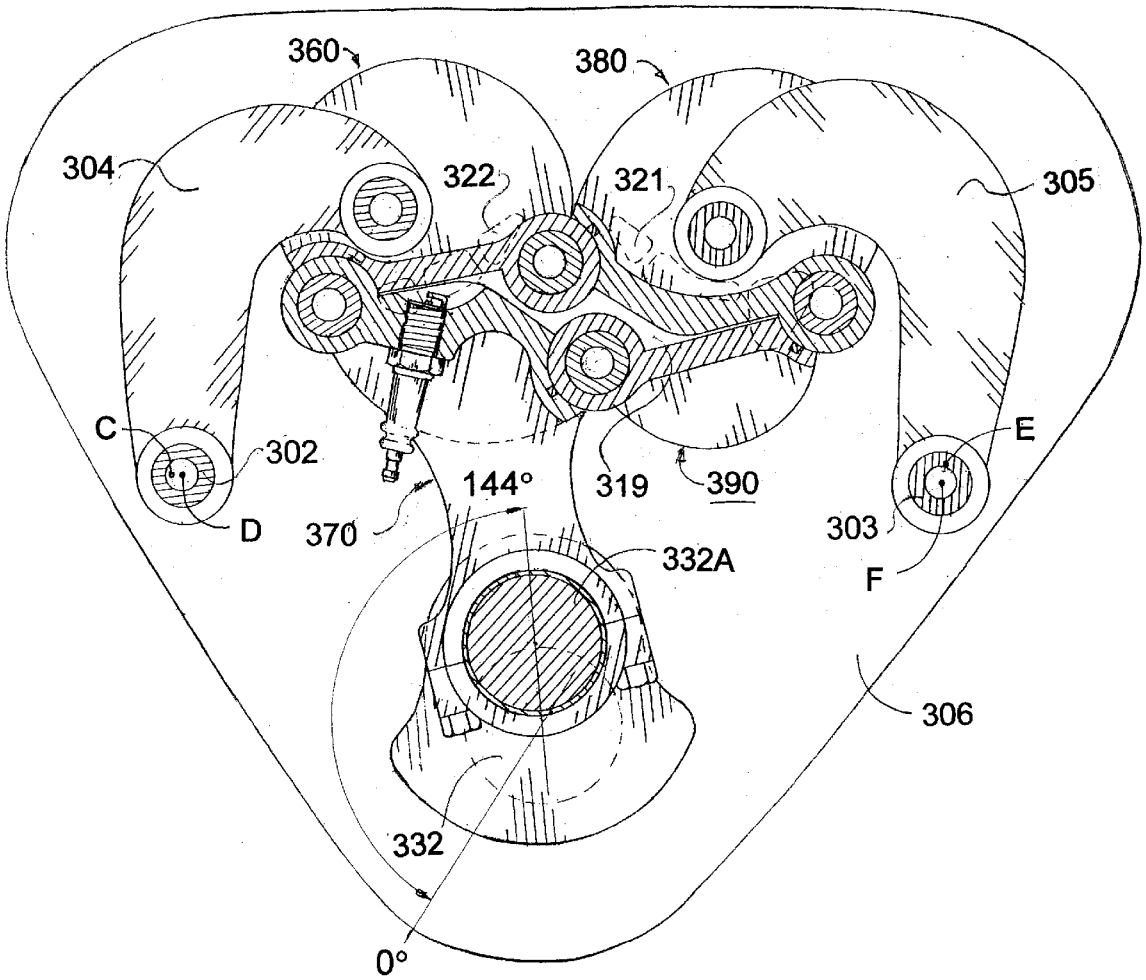
FIG. 35C is a view similar to that of FIG. 25E with two link shafts shifted.

FIG. 35C shows the combustion chamber 319 at a minimum volume between the end of the exhaust and the beginning of intake as this minimum volume will be substantially the same after shifting of link shafts 302 from C to D and link shaft 303 from E to F, indicating that no interference will occur and therefore the displacement C to D and E to F can occur during any portion of the cycle. It is to be appreciated that link shafts 302 and 303 may be displaced by relatively small amounts in any direction to increase and/or decrease the duration and opening of the intake ports 321 and exhaust ports 322 and in addition change the compression ratio.

I claim:

1. An internal combustion engine comprising:

a crankcase and an engine block connected together;

a gas control chamber formed within the engine block, said chamber having at least one curved and two planar walls;

a crankshaft operatively disposed in the crankcase;

first and second connecting rods operatively connected to the crankshaft, said connecting rods extending from the crankcase into the gas control chamber; and an arrangement of vane assemblies operatively disposed in the gas control chamber, said vane assemblies being operatively connected to each other and said first and second connecting rods.

2. The engine of claim 1 wherein said vane assemblies are adapted to pivot relative to each other and cause the rotation of the crankshaft in response to combustion of fuel within said gas control chamber.

3. The engine of claim 1 wherein said arrangement of vane assemblies comprises:

first, second, third, and fourth vane assemblies disposed in the gas control chamber;

a first pin pivotally connecting the first connecting rod to the first vane assembly;

a second pin pivotally connecting the first vane assembly to the second vane assembly;

a third pin pivotally connecting the second vane assembly to the third vane assembly;

a fourth pin pivotally connecting the third vane assembly to the fourth vane assembly;

a fifth pin pivotally connecting the fourth vane assembly to the second connecting rod; and a sixth pin pivotally connecting the first vane assembly to the fourth vane assembly.

4. The engine of claim 3, wherein said sixth pin includes a first end rotatably secured in a first of said at least two planar interior walls of the gas control chamber and a second end rotatably secured in a second of said at least two planar interior walls of the gas control chamber.

5. The engine of claim 3, wherein said first and fourth vane assemblies are adapted to be directly driven in response to combustion of fuel in said gas control chamber.

6. The engine of claim 1, wherein each of said vane assemblies includes a curved outer edge adapted to slidably engage the curved interior wall of said gas control chamber.

7. The engine of claim 3, further comprising a spark plug attached to the first vane assembly.

8. The engine of claim 1, further comprising an arrangement of flanges extending from at least one of said vane assemblies into slidable contact with the gas control chamber interior wall.

9. The engine of claim 8, further comprising means for biasing said flanges into contact with at least one of said gas control chamber planar interior walls.

10. The engine of claim 8, wherein said flanges are curved along their respective lengths.

11. The engine of claim 1, further comprising an oil scraper ring extending from said at least one of said vane assemblies into slidable contact with the gas control chamber interior wall.

12. The engine of claim 1, further comprising at least one valveless intake port provided in one of said gas control chamber interior walls and at least one valveless exhaust port provided in one of said gas control chamber interior walls.

13. The engine of claim 1 wherein said arrangement of vane assemblies comprises:

first, second, third, fourth, and fifth vane assemblies disposed in the gas control chamber;

a first pin pivotally connecting the first connecting rod to the first vane assembly;

a second pin pivotally connecting the first vane assembly to the second vane assembly;

a third pin pivotally connecting the second vane assembly to the third vane assembly;

a fourth pin pivotally connecting the third vane assembly to the fourth vane assembly;

a fifth pin pivotally connecting the fourth vane assembly to the fifth vane assembly;

a sixth pin pivotally connecting the fifth vane assembly to the second connecting rod; and a seventh pin pivotally connecting the first vane assembly to the fifth vane assembly.

14. The engine of claim 1, further comprising a gas seal extending from said at least one of said vane assemblies into slidable contact with the gas control chamber interior wall.

15. An internal combustion engine comprising:

a block having a crankshaft and a combustion chamber defined by fixed coplanar walls;

four vanes disposed in said combustion chamber, each of said vanes having two ends and each end being defined by a vane boss, wherein the four vanes are connected end to end to form a four-sided circuit with four common rotational points, and wherein the opposite sides of the four-sided circuit are equal in length and the adjacent sides of the circuit are unequal in length to permit nesting of the vane bosses to provide adequate vane pivot;

flanges provided on each vane and in sliding contact with said coplanar walls to provide for heat transfer and a sealing surface to define an interior volume for the four-sided circuit; and means for coupling said four-sided circuit to said crankshaft so as to convert oscillation of the interior volume of the four-sided circuit into rotational motion of the crankshaft.

16. The internal combustion engine of claim 15, further comprising:

a pivot shaft bisecting said coplanar walls and in operational contact with one rotational point to permit said four vanes to rotate around said pivot shaft; and a first connecting rod rotationally connected to a first said vane and a second connecting rod rotationally connected to a second said vane to permit rotation of said vanes together and apart and back together again to change said interior volume.

17. The internal combustion engine of claim 15, further comprising:

a first link having one end rotationally connected to said coplanar walls by a pivot shaft and an opposite end rotationally connected by a wrist pin to a first said vane;

a second link having one end rotationally connected to said coplanar walls by a second pivot shaft and an opposite end rotationally connected by a wrist pin to a second vane; and a third link rotationally driving said crankshaft in response to the rotation of said vanes together and apart in said combustion chamber.

18. The internal combustion engine of claim 16, further comprising:

at least one intake port in said coplanar walls in communication with the said combustion chamber, said intake port being slidably opened and closed by movement of a first said vane; and at least one exhaust port in said coplanar walls in communication with the said combustion chamber, said exhaust port being slidably opened and closed by movement of a second said vane.

19. The internal combustion engine of claim 17, further comprising:

at least one intake port in said coplanar walls in communication with the said combustion chamber, said intake port being slidably opened and closed by movement of a first said vane; and at least one exhaust port in said coplanar walls in communication with the said combustion chamber, said exhaust port being slidably opened and closed by movement of a second said vane.

20. The internal combustion engine of claim 18, wherein:

said intake ports are shaped to control the opening and closing times of said combustion chamber during the intake stroke, and said exhaust ports are shaped to control the opening and closing times of said combustion chamber during the exhaust stroke.

21. The internal combustion engine of claim 19, wherein:

said intake ports are shaped to control the opening and closing times of said combustion chamber during the intake stroke, and said exhaust ports are shaped to control the opening and closing times of said combustion chamber during the exhaust stroke.

22. The internal combustion engine of claim 15, further comprising a sealing grid for said combustion chamber, said seals being urged against respective sealing surfaces by spring pressure and gas pressure in said combustion chamber, and wherein the sealing grid comprises for each said vane:

an annular seal located at said rotational ends of said vanes to seal against said coplanar walls;

a plurality of face seals located in said flanges with a first end of said face seal driving said annular seal, a second end of said face seal slidably located against and adjacent said annular seal,to seal said flanges and said coplanar walls;

a combination gas seal and oil scraper seal located in said flanges and slidably located between said annular seals to seal and remove excess lubrication;

an axial seal parallel to the axis of said rotational end to seal a leakage path between adjacent said vanes;

a first radial face seal located by a groove in said annular seal; and a second radial face seal located by a groove in said vane to seal said vane to said annular seal.

23. The internal combustion engine of claim 15, further comprising faces on said vanes, and wherein the faces mate with said combustion chamber shaped to increase the compression ratio.

24. The internal combustion engine of claim 23, wherein the faces on said vanes have a plurality of channels to provide swirl and turbulence at an end of a compression stroke and a beginning of a combustion stroke.

25. The internal combustion engine of claim 23, wherein the faces on said vanes have a plurality of channels to direct exhaust gases out of the said combustion chamber and into the exhaust port, and to promote flow of intake gases at an end of an exhaust stroke and a beginning of an intake stroke.

26. The internal combustion engine of claim 19 further comprising means for displacing at least one of said pivot shafts to vary a compression ratio without substantially changing parasitic volume of said combustion chamber between intake and exhaust strokes.

27. The internal combustion engine of claim 19 further comprising means for displacing at least one of said pivot shafts to vary parasitic volume between intake and exhaust strokes without substantially changing a compression ratio.

28. The internal combustion engine of claim 19 further comprising means for displacing at least one of said pivot shafts to vary a combustion ratio and parasitic volume between exhaust and intake strokes.

29. The internal combustion engine of claim 19 further comprising means for displacing both said pivot shafts to vary duration and aperture of said intake and said exhaust ports.

30. The internal combustion engine of claim 19 further comprising means for displacing said first link and said second link to substantially reduce the compression ratio and to keep said exhaust or said intake port open during a four stroke engine cycle to reduce the power required to idle or start the engine.

31. The internal combustion engine of claim 15 further comprising at least one spark plug located in a vane to reduce flame front travel.

32. The internal combustion engine of claim 15 further comprising:

a precombustion chamber located between said coplanar walls; and a fuel injector for a compression ignition engine.

33. The internal combustion engine of claim 15 further comprising at least one spark plug located in one of said coplanar walls to provide for ignition.

34. The internal combustion engine of claim 15, wherein said flanges of said vanes are large enough to cover said exhaust and said intake ports of said combustion chamber to increase compression ratio and provide adequate bearing areas in said vane rotational ends.

35. A method of operating an internal combustion engine having 4 vanes with opposite vanes being equal in length and adjacent vanes unequal in length to provide a higher compression ratio with the 4 said vanes rotatably connected end to end in a circuit to form a combustion chamber assembly, said combustion chamber assembly being defined by the inner sides of four said vanes that are also slidably bounded by the coplanar walls of a block with at least one intake port and at least one exhaust port located in said coplanar wall slidably opened by the said vanes, having a first link with one end rotationally located in a first said vane by a wrist pin, having the opposite end rotatably located in said block with a first pivot shaft and having means to position said first pivot shaft with respect to said block, having a second link with one end rotationally located in a second said vane by a wrist pin, having the opposite end rotationally located in said block with a second pivot shaft with means to position said second pivot pin with respect to said block, having a third said vane rotatably connected to a crankshaft, comprising the steps of:

positioning at least one said pivot shaft to vary the compression ratio of said combustion chamber;

positioning at least one said pivot shaft to vary the volume of said combustion chamber assembly at the end of the exhaust stroke and the beginning of the intake stroke; and positioning at least one said pivot shaft to vary both the compression ratio and the volume at the end of the exhaust stroke and the beginning of the intake stroke of said combustion chamber assembly.

36. The method as set forth in claim 35 comprising the step of shifting a first pivot pin to vary both the aperture and duration of said intake port and said exhaust port.

37. The method as set forth in claim 35 further comprising the steps of:

shifting a first pivot pin; and shifting a second pivot pin to cause the said exhaust port and said intake port to remain open and reduce the compression ratio so the torque necessary to start the engine is substantially reduced.

38. The method as set forth in claim 35 further comprising the step of positioning at least one of said pivot shafts to increase the volume of said combustion chamber at the end of the exhaust stroke and beginning of the intake stroke to retain more of the exhaust gas to buffer and thereby reduce the temperature of the combustion stroke that follows thereby reducing the formation of exhaust pollutants.

39. The method as set forth in claim 35 wherein said vanes have channels in opposing faces to direct the gases towards each other to provide squish during the compression cycle causing the gases to flow with a higher velocity across the walls of said combustion chamber assembly thereby absorbing heat from said walls and lowering the temperature of the combustion bases during the following combustion cycle to reduce formation of the exhaust pollutants that are formed at higher temperatures.

40. The method as set forth in claim 35 further comprising the steps of:

absorbing heat from the incoming gas and lowering the final combustion temperature to reduce nitrous oxide pollution by developing a swirl, using offset channels in said vanes with this swirl across the said combustion chamber sweeping across the said vanes to cool the compressed gas with accelerating velocity due to conservation of moment of momentum.

* * * * *